US007971466B2

(12) United States Patent
Yoshitome et al.

(10) Patent No.: US 7,971,466 B2
(45) Date of Patent: Jul. 5, 2011

(54) PRESS-FORMED MEMBER HAVING CORNER PORTION, PRESS-FORMED MEMBER MANUFACTURING APPARATUS AND PRESS-FORMED MEMBER MANUFACTURING METHOD

(75) Inventors: Masaaki Yoshitome, Sagamihara (JP); Hidenobu Matsuyama, Yokosuka (JP); Shinichi Matsuda, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 986 days.

(21) Appl. No.: 11/606,227

(22) Filed: Nov. 30, 2006

(65) Prior Publication Data

US 2007/0125149 A1 Jun. 7, 2007

(30) Foreign Application Priority Data

Dec. 1, 2005 (JP) ..... 2005-348083
Aug. 8, 2006 (JP) ..... 2006-215960

(51) Int. Cl.
*B21D 22/00* (2006.01)
*B21D 31/00* (2006.01)
*B21J 13/02* (2006.01)

(52) U.S. Cl. ..... 72/356; 72/355.2; 72/377

(58) Field of Classification Search ..... 72/352, 72/353.2, 354.2, 356, 357, 358, 360, 377, 72/713, 355.2, 354.6, 354.8, 355.6, 359, 72/381, 383, 386, 389.1, 343
See application file for complete search history.

(56) References Cited

U.S. PATENT DOCUMENTS

| | | | | |
|---|---|---|---|---|
| 4,434,640 | A * | 3/1984 | Walter et al. | 72/348 |
| 5,924,188 | A | 7/1999 | Tokunou et al. | |
| 5,996,391 | A * | 12/1999 | Mizobuchi | 72/348 |
| 7,490,503 | B1 * | 2/2009 | Kanemitsu et al. | 72/379.2 |
| 2004/0216505 | A1 | 11/2004 | Knaup | |

FOREIGN PATENT DOCUMENTS

| | | |
|---|---|---|
| DE | 10303184 | 4/2004 |
| EP | 0592908 | 4/1994 |
| JP | 63-117606 | 7/1988 |
| JP | 10-329503 | 12/1998 |
| JP | 2001-238297 A | 8/2001 |
| JP | 2001-314921 | 11/2001 |
| JP | 2003-112260 | 4/2003 |

OTHER PUBLICATIONS

The Japanese Office Action of corresponding Japanese Application No. 2006-215960, dated Oct. 22, 2010 and mailed Oct. 26, 2010.

* cited by examiner

*Primary Examiner* — Debra M Sullivan
(74) *Attorney, Agent, or Firm* — Global IP Counselors, LLP

(57) ABSTRACT

A press-formed member includes a first wall with a first thickness, a second wall with a second thickness, and a first corner portion. The first corner portion is disposed between the first and second walls, with the first corner portion having an increased thickness formed by pressure-forming such that the increased thickness of the first corner portion is larger than the first and second thicknesses of the first and second walls adjacent to the first corner portion. In a manufacturing method for the press-formed member, a preliminary body structure to be deformed is provided, and the thickness of the first corner portion of the preliminary body structure is increased by applying pressure to the preliminary body structure.

8 Claims, 18 Drawing Sheets

PRESS-FORMED MEMBER HAVING CORNER PORTION, PRESS-FORMED MEMBER MANUFACTURING APPARATUS AND PRESS-FORMED MEMBER MANUFACTURING METHOD

CROSS-REFERENCE TO RELATED APPLICATIONS

This application claims priority to Japanese Patent Application Nos. 2005-348083, filed on Dec. 1, 2005, and 2006-215960 filed on Aug. 8, 2006. The entire disclosures of Japanese Patent Application Nos. 2005-348083 and 2006-215960 are hereby incorporated herein by reference.

BACKGROUND OF THE INVENTION

1. Field of the Invention

The present invention relates to a press-formed member having a corner portion, a press-formed member manufacturing apparatus configured and arranged to manufacture the press-formed member having the corner portion, and a press-formed member manufacturing method for manufacturing the press-formed member having the corner portion.

2. Background Information

Japanese Laid-Open Utility Model Application Publication No. 63-117606A discloses a conventional press-formed member including a bent portion (corner portion), such as a suspension part used in a vehicle. The conventional press-formed member disclosed in this reference is manufactured by press forming or press working a blank member (sheet metal blank).

Japanese Laid-Open Patent Publication No. 2003-12260 discloses a frame structure in which a deposit-welded bead portion is formed on a corner portion of a frame member to improve the rigidity of the frame member.

In view of the above, it will be apparent to those skilled in the art from this disclosure that there exists a need for an improved press-formed member having a corner portion, an improved press-formed member manufacturing apparatus, and an improved press-formed member manufacturing method. This invention addresses this need in the art as well as other needs, which will become apparent to those skilled in the art from this disclosure.

SUMMARY OF THE INVENTION

Although the press forming method provides excellent productivity, the thickness of the bent portion (corner portion) of the conventional press-formed member is reduced during the press forming process. Therefore, it is necessary to use a thick plate blank member as the material of the press-formed member to ensure the rigidity of the press-formed member taking into account that the thickness of the corner portion is reduced during the press forming process. Therefore, in the conventional press-formed member manufacturing method the weight of the press-formed member is increased and the material cost (manufacturing cost) is increased.

On the other hand, when welding (such as deposit-welding) is utilized to improve the rigidity of a press-formed member, the increase in the weight of the member is relatively small. However, the welding process is time-consuming, and thus, the productivity drops and the manufacturing cost increases.

The present invention is contrived to solve the problems accompanying the above-described conventional art, and one object of the present invention is to provide a press-formed member manufacturing method that can reduce the manufacturing cost and the weight of the press-formed member including a corner portion, a press-formed member manufacturing apparatus that can reduce the manufacturing cost and the weight of the press-formed member including the bent corner portion.

In order to achieve the above mentioned object, a press-formed member manufacturing method includes providing a preliminary body structure to be deformed, and increasing a thickness of a corner portion of the preliminary body structure by applying pressure to the preliminary body structure.

In accordance with another aspect of the present invention, a press-formed member manufacturing apparatus includes a thickness increasing device configured and arranged to apply pressure to a preformed body to increase a thickness of a corner portion of the preliminary body structure.

In accordance with further another aspect of the present invention, a press-formed member includes a first wall with a first thickness, a second wall with a second thickness, and a first corner portion. The first corner portion is disposed between the first and second walls, with the first corner portion having an increased thickness formed by pressure-forming such that the increased thickness of the first corner portion is larger than the first and second thicknesses of the first and second walls adjacent to the first corner portion.

These and other objects, features, aspects and advantages of the present invention will become apparent to those skilled in the art from the following detailed descriptions, which, taken in conjunction with the annexed drawings, discloses preferred embodiments of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Referring initially to FIGS. 1 to 15, a press-formed member, a press-formed member manufacturing apparatus and a press-formed member manufacturing method are illustrated in accordance with a first embodiment of the present invention.

Figure 1:
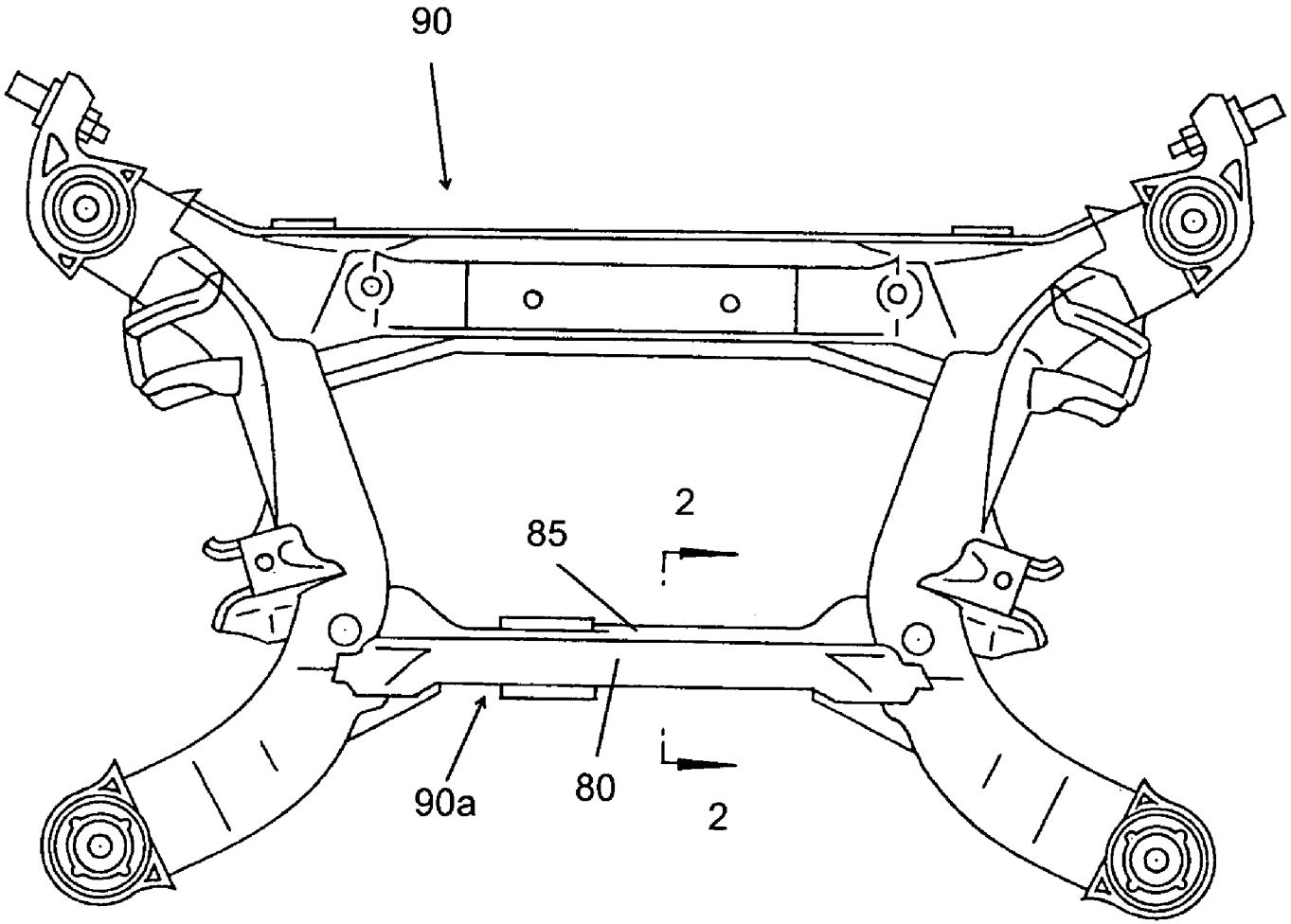
FIG. 1 is a top plan view of a vehicle structure part including a plurality of press-formed members in accordance with a first embodiment of the present invention.
Figure 2:
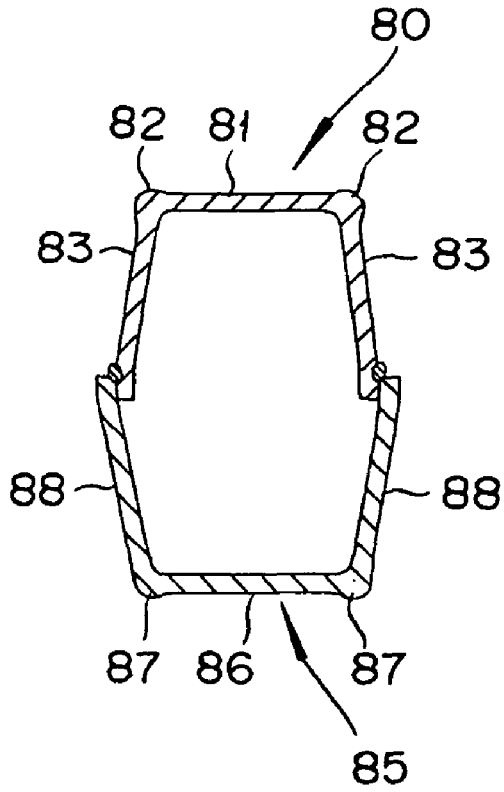
FIG. 2 is a cross-sectional view of the press-formed members of the vehicle structure part in accordance with the first embodiment of the present invention taken along a section line 2-2 in FIG. 1.
Figure 3:
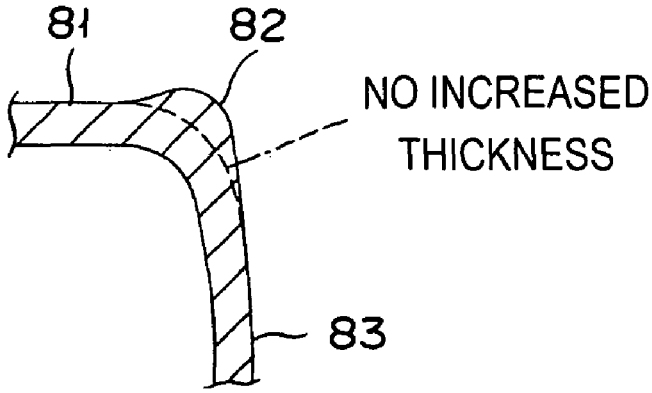
FIG. 3 is an enlarged partial cross sectional view of a corner portion of one of the press-formed members illustrated in FIG. 2 in accordance with the first embodiment of the present invention.

FIG. 1 is a top plan view of a vehicle structure part (suspension part 90) including a pair of press-formed members 80 and 85 in accordance with the first embodiment of the present invention. FIG. 2 is a cross-sectional view of the press-formed members 80 and 85 of the suspension part 90 taken along a section line 2-2 in FIG. 1. FIG. 3 is an enlarged partial cross sectional view of a corner portion 82 of the press-formed member 80 illustrated in FIG. 2.

The suspension part 90 is used to couple an axle part and a vehicle body together. The suspension part 90 includes a hollow transverse member 90*a* having a substantially rectangular closed cross sectional shape. The hollow transverse member 90*a* is formed by joining edge portions of the press-formed members 80 and 85 as shown in FIG. 2. More specifically, each of the press-formed members 80 and 85 has a substantially hat-shaped cross sectional shape. As seen in FIG. 2, the press-formed member 80 includes a connecting wall 81, a bent corner portion 82 (first and second corner portions), and a pair of side walls 83 that are separated by the connecting wall 81. The connecting wall 81 couples end portions of the side walls 83 so that the corner portion 82 is disposed between the connecting wall 81 and the side walls 83. Likewise, the press-formed member 85 includes a connecting wall 86, a bent corner portion 87 (first and second corner portions), and a pair of side walls 88 that are separated by the connecting wall 86. The connecting wall 86 couples end portions of the side walls 88 so that the corner portion 87 is disposed between the connecting wall 81 and the side walls 83.

Each of the press-formed members 80 and 85 is formed by pressure-forming a plate-shaped blank member (e.g., a sheet metal). When a conventional press-formed member manufacturing method is used to form a press-formed member, a corner portion of the press-formed member has a reduced thickness, and thus, the rigidity of the corner portion may not be sufficient. However, in accordance with the press-formed member manufacturing method of the present invention, the thickness of the corner portion 82 and 87 of the press-formed members 80 and 85, respectively, is increased in the manufacturing process, whereby the rigidity of the press-formed members 80 and 85 is improved without significantly changing the cross-sectional shapes of the press-formed members 80 and 85. Therefore, an increase in the weight of the press-formed members 80 and 85 and an increase in the material cost (manufacturing cost) can be controlled, which result from using a thick plate blank member as the material for the press-formed member taking into consideration that the thickness of the corner portion is reduced. Moreover, because the pressure-forming process has excellent productivity in comparison to the welding process which is sometimes used in the conventional art to increase the rigidity of the corner portion, it is possible to control an increase in the manufacturing cost with the present invention.

The pressure-forming process performed in the preset invention is preferably a press forming or press working. Moreover, the blank member used in the present invention is preferably a semi-manufactured article that has been prepared for pressure-forming such as a metal plate or the like.

Figure 4:
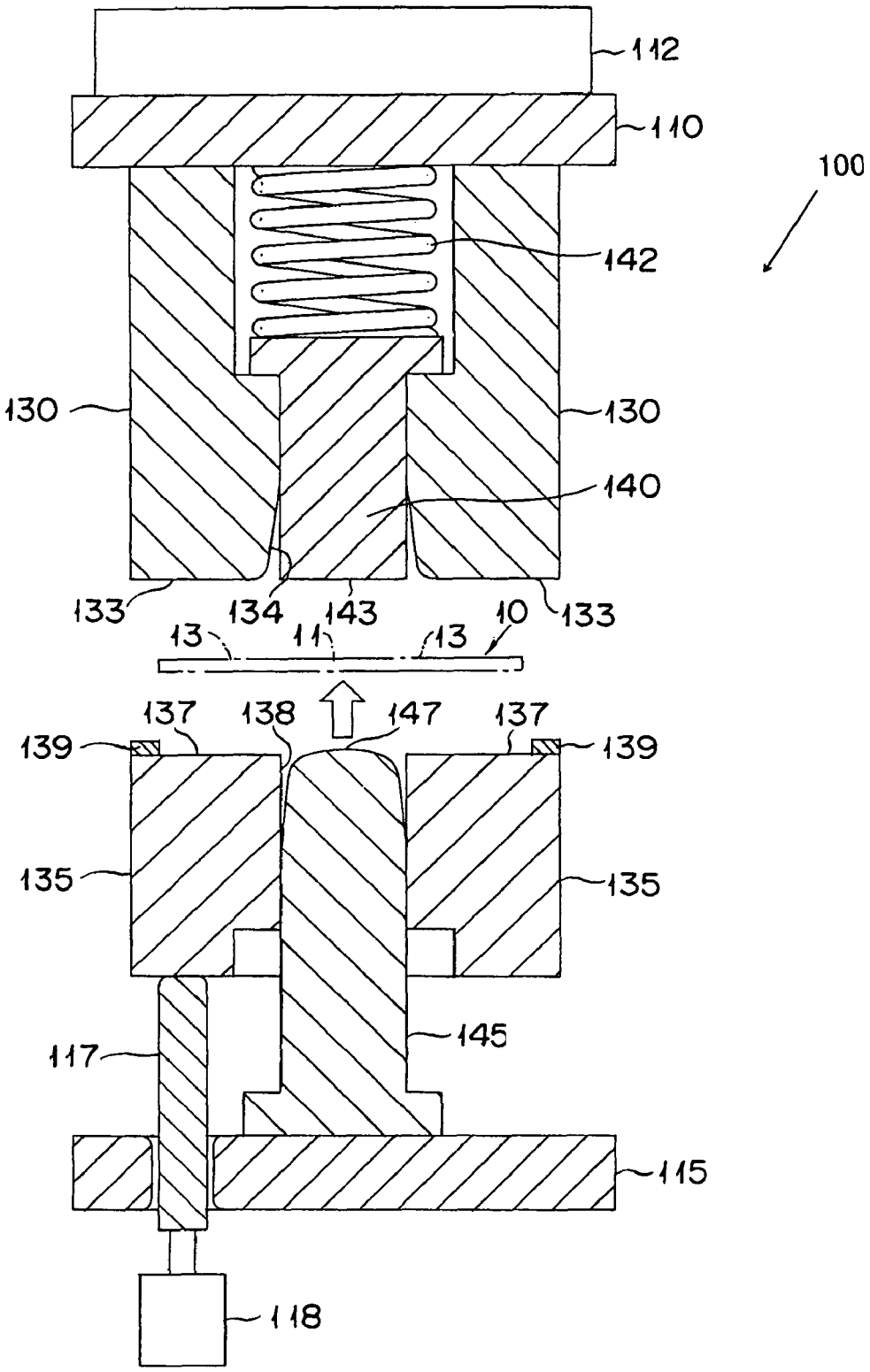
FIG. 4 is a cross-sectional view of a preforming device of a press-formed member manufacturing apparatus in accordance with the first embodiment of the present invention.
Figure 5:
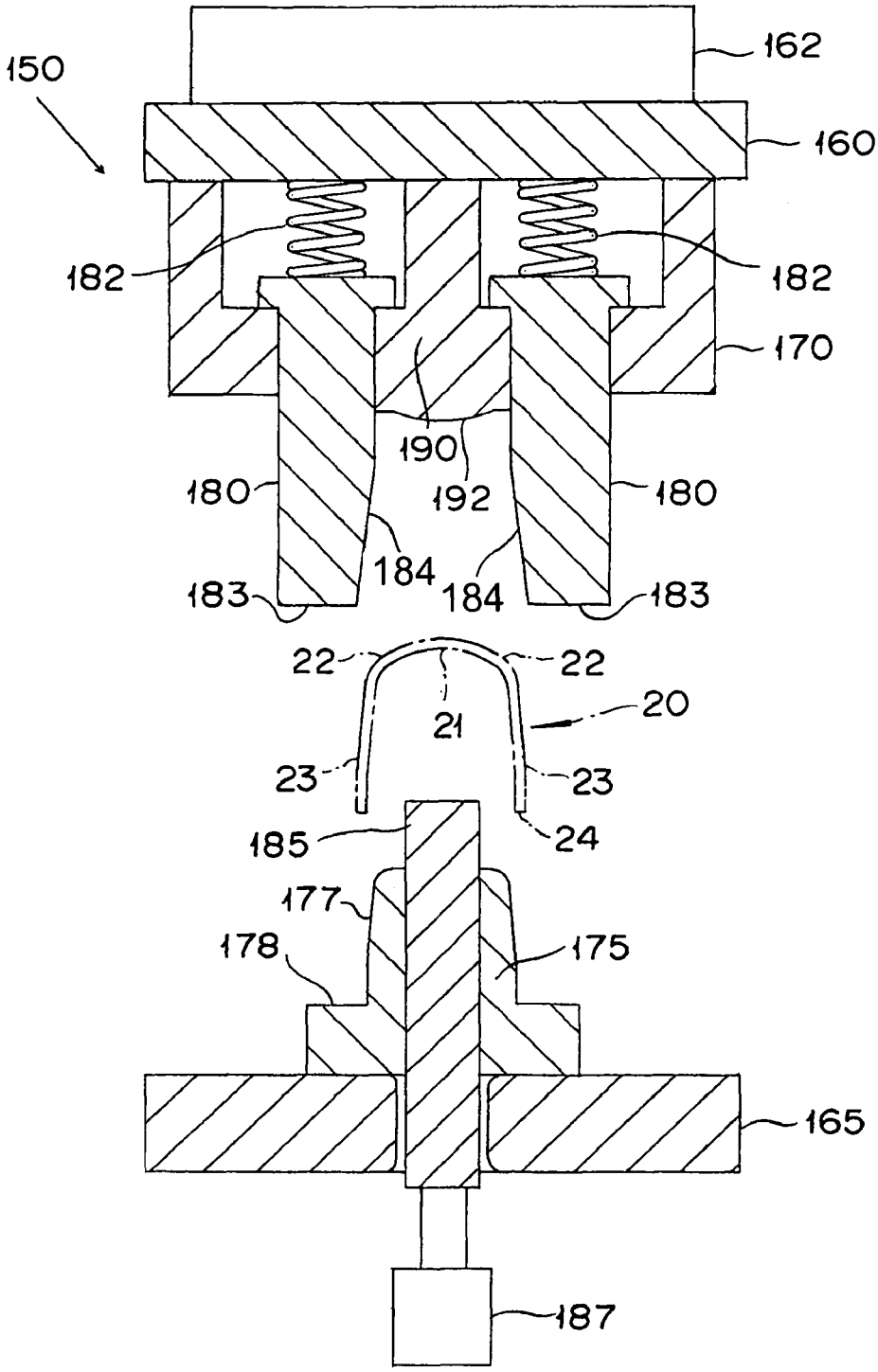
FIG. 5 is a cross-sectional view of a thickness increasing device of the press-formed member manufacturing apparatus having a forming die in accordance with the first embodiment of the present invention.

The press-formed members 80 and 85 are preferably formed by using a press-formed member manufacturing apparatus of the first embodiment of the present invention. Referring now to FIGS. 4 and 5, a preforming device 100 and a thickness increasing device 150 of the press-formed member manufacturing apparatus in accordance with the first embodiment will be described. FIG. 4 is a cross-sectional view of the preforming device 100, and FIG. 5 is a cross-sectional view of the thickness increasing device 150. The preforming device 100 is configured and arranged to pressure-form a plate-shaped blank member 10 to form a preformed or preliminary body structure 20 (shown in FIG. 5) including a bent corner portion 22. The thickness increasing device 150 is configured and arranged to increase the thickness of the corner portion 22 of the preformed body structure 20 to form the press-formed member 80 (or 85).

The preforming device 100 and the thickness increasing device 150 will be described in more detail.

The preforming device 100 shown in FIG. 4 is used to bend the sheet-shaped blank member 10 to form the preformed body structure 20 that has a generally hat-shaped cross section as illustrated in detail in FIG. 5. The preformed body structure 20 includes the corner portion 22 that connects a connecting wall 21 and a pair of side walls 23. The preforming device 100 includes an upper die portion and a lower die portion that is disposed on the opposite side of the upper die portion with respect to the blank member 10.

As shown in FIG. 4, the upper die portion of the preforming device 100 includes a holder 110, a drive device 112, an upper die 130, and an upper assist die 140.

The holder 110 holds or supports the upper die 130 and the upper assist die 140 with a spring 142 being disposed therein. More specifically, the spring 142 is disposed between the holder 110 and the upper assist die 140 to elastically support the upper assist die 140. Alternatively, the preforming device 100 can include a structure utilizing a cushion pin or a pressure pin instead of the spring 142.

The drive device 112 is, for example, a hydraulic drive device that is configured and arranged to selectively move the holder 110 toward and away from the lower die portion.

The upper die 130 includes an outer peripheral portion 133 and a cavity surface 134. The cavity surface 134 is arranged to substantially match an outer contour of the press-formed member (more specifically, an outer contour of side surfaces of the press-formed member).

The upper assist die 140 is set so as to freely slide inside the cavity surface 134 and includes a substantially flat press surface 143 that is configured and arranged to contact a first section 11 of the blank member 10. The first section 11 of the blank member 10 is a portion that forms the connecting wall 21 of the preformed body structure 20.

As shown in FIG. 4, the lower die portion of the preforming device 100 includes a holder 115, a pin 117, a support device 118, a lower die 135, and a lower male die 145. The holder 115 supports the lower male die 145.

The pin 117 penetrates the holder 115 and contacts the lower die 135. The support device 118 is, for example, a hydraulic drive device that elastically supports the pin 117. Therefore, the pin 117 functions as a cushion pin or a pressure pin.

The lower die 135 includes an outer peripheral portion 137 and an opening 138.

The lower male die 145 is disposed so as to selectively protrude from the opening 138. The lower male die 145 further includes a press surface 147 (preforming press surface) formed in a distal end portion (top portion in FIG. 4) thereof. The press surface 147 is configured and arranged to contact the first section 11 of the blank member 10. The press surface 147 is formed to substantially match the inner surface shape of the preformed body structure 20. More specifically, in the first embodiment, the press surface 147 has a convexly (outwardly) curved shape as shown in FIG. 4.

The first section 11 of the blank member 10 is disposed so as to face the cavity surface 134 of the upper die 130 and the opening 138 of the lower die 135. The blank member 10 further includes a pair of second sections 13 disposed on opposite sides of the first section 11. The second sections 13 of the blank member 10 are disposed so as to face the outer peripheral portions 133 and 137 of the upper die 130 and the lower die 135, respectively, as shown in FIG. 4. The second sections 13 of the blank member 10 are portions that form the side walls 23 of the preformed body structure 20.

The outer peripheral portions 133 and 137 of the upper die 130 and the lower die 135, respectively, are configure and arranged to guide the movement of the second sections 13 of the blank member 10 when the first section 11 of the blank member 10 is being bent so that the occurrence of wrinkles, for example, is prevented. A spacer 139 is preferably disposed between the outer peripheral portions 133 and 137.

The upper and lower die portions of the preforming device 100 are arranged such that the clearance between the lower male die 145 and the cavity surface 134 when the lower male die 145 protrudes toward the cavity surface 134 of the upper die 130 substantially matches the thickness of the blank member 10.

The lower male die 145 protrudes in a direction (bending direction) toward the cavity surface 134 of the upper die 130 so that the lower male die 145 presses and bends the first section 11 of the blank member 10. Also, the upper assist die 140 moves simultaneously with the protruding movement of the lower male die 145 and retreats in the bending direction. The moving amounts of the upper assist die 140 and the lower male die 145 substantially match the size (length) of the second sections 13 of the blank member 10.

As described above, the preforming device 100 is configured and arranged to pressure-form the blank member 10 to form the preformed body structure 20 including the bent corner portion 22. As shown in FIG. 5, the preformed body structure 20 has a generally hat-shaped cross sectional shape including the side walls 23 and the connecting wall 21 that couples the end portions of the side walls 23. The corner portion 22 is disposed between the connecting wall 21 and the side walls 23. As shown in FIG. 5, the connecting wall 21 of the preformed body structure 20 has a convexly curved shape because the press surface 147 of the lower male die 145 has the convexly curved shape. The upper assist die 140 of the preforming device 100 may be omitted depending on, for example, the final shape of the press-formed member (such as the shape of the press-formed member 80 or 85).

Next, the thickness increasing device 150 of the press-formed member manufacturing apparatus in accordance with the first embodiment will be described. The thickness increasing device 150 is configured and arranged to increase the thickness of the corner portion 22 of the preformed body structure 20 that is formed by the preforming device 100. The thickness increasing device 150 includes a lower die portion (first thickness increasing die portion) and an upper die portion (second thickness increasing die portion) that are configured and arranged to pressure-form the preformed body structure 20 such that part of material in the connecting wall 21 of the preformed body structure 20 flows toward the corner portion 22 to increase the thickness of the corner portion 22.

As shown in FIG. 5, the upper die portion of the thickness increasing device 150 includes a holder 160, a drive device 162, an upper die 170, an upper assist die 180, and an upper male die 190.

The holder 160 holds or supports the upper die 170, the upper assist die 180, and the upper male die 190 with a pair of springs 182 being disposed therein. More specifically, the springs 182 are disposed between the holder 160 and the upper assist die 180 to elastically hold the upper assist die 180. Alternately, the thickness increasing device 150 can include a structure utilizing a cushion pin or a pressure pin instead of the springs 182. The drive device 162 is, for example, a hydraulic drive device that is configured and arranged to selectively move the holder 160 toward and away from the lower die portion.

The upper die 170 forms a base portion including an opening where the upper assist die 180 and the upper male die 190 are disposed. The upper assist die 180 includes an outer peripheral portion 183 and a pair of side walls 184. The side walls 184 are arranged to substantially match the outer contour of the side walls of the press-formed member.

The upper male die 190 includes a press surface 192 (thickness increasing press surface) that is arranged to press the connecting wall 21 of the preformed body structure 20 toward the side walls 23 of the preformed body structure 20. The press surface 192 substantially matches the outer contour of the connecting wall of the press-formed member, and has a convexly (outwardly) curved shape with the peripheral edge being slightly recessed. Accordingly, in the first embodiment of the present invention, the side walls 184 of the upper assist die 180 and the press surface 192 of the upper male die 190 integrally form a cavity surface corresponding to the outer contour of the press-formed member.

The lower die portion of the thickness increasing member 150 is disposed on the opposite side of the upper die portion with respect to the preformed body structure 20. The preformed body structure 20 is disposed between the upper die portion and the lower die portion. As shown in FIG. 5, the lower die portion includes a holder 165, a lower die 175, a lower assist die 185, and a support device 187.

The holder 165 supports the lower die 175. The holder 165 includes an opening through which the lower assist die 185 is inserted.

The lower die 175 includes a core portion 177, a flange portion 178, and an opening through which the lower assist die 185 is inserted. The core portion 177 protrudes toward the upper die portion from the flange portion 178. The core portion 177 includes a pair of side walls that substantially match the inner contour of the side walls of the press-formed member.

The lower assist die 185 is disposed so as to freely slide in the openings formed in the holder 165 and the lower die 175. The support device 187 is, for example, a hydraulic support that is configured and arranged to elastically support the lower assist die 185. Therefore, the lower assist die 185 functions as a cushion pin or a pressure pin.

The end surface (top surface in FIG. 5) of the lower die 175 and the end surface (top surface in FIG. 5) of the lower assist die 185 integrally match the inner contour of the connecting wall of the press-formed member and integrally form a substantially flat press surface that supports the connecting wall 21 of the preformed body structure 20.

Accordingly, the side walls of the core portion 177, the end surface of the lower die 175, and the end surface of the lower assist die 185 integrally form a cavity surface corresponding to the inner contour of the press-formed member. On the other hand, as described above, the side walls 184 of the upper assist die 180 and the press surface 192 of the upper male die 190 integrally form a cavity surface corresponding to the outer contour of the press-formed member.

Therefore, when the holder 165 descends and the outer peripheral portion 183 of the upper assist die 180 contacts the flange portion 178 of the lower die 175, a cavity corresponding to the cross-sectional shape of the press-formed member is formed between the upper and lower die portions of the thickness increasing device 150. The clearance or height of sections of the cavity corresponding to the corner portion of the press-formed member is greater than other sections of the cavity and forms an empty space or an open space that allows the flow of the material of the connecting wall 21 of the preformed body structure 20 toward the corner portion 22.

The preformed body structure 20 is disposed so as to be fitted to the core portion 177 of the lower die 175, and the connecting wall 21 and the side walls 23 of the preformed body structure 20 face the end surface and the outer peripheral surface of the core portion 177, respectively. In other words, the lower die 175 is disposed on the back side of the bent surface of the connecting wall 21.

Moreover, as shown in FIG. 5, the peripheral edges of the end surface of the core portion 177 preferably have a bent shape to facilitate material movement.

Furthermore, when the upper assist die 180 descends during the pressure-forming process, the upper assist die 180 is positioned on the opposite side of the core portion 177 with respect to the side walls 23 of the preformed body structure 20. In other words, the side walls 23 of the preformed body structure 20 are sandwiched between the side walls 184 of the upper assist die 180 and the outer peripheral surface of the core portion 177. The side walls 184 of the upper assist die 180 and the outer peripheral surface of the core portion 177 restrain the movement of the side walls 23 of the preformed body structure 20. Moreover, a pair of free end surfaces 24 of the side walls 23 disposed opposite from the corner portion 22 contacts an abutment surface (top surface in FIG. 5) of the flange portion 178 of the lower die 175 during the pressure-forming process. Thus, since the preformed body structure 20 is restrained during the pressure-forming process, it is possible for the press surface 192 of the upper male die 190 to reliably press the connecting wall 21 of the preformed body structure 20 toward the side walls 23. The side walls 184 of the upper assist die 180, the outer peripheral surface of the core portion 177 and the flange portion 178 of the lower die 175 together constitute a side wall restraining section of the present invention.

Referring now to FIGS. 6 to 11, a press-formed member manufacturing method using the press-formed member manufacturing apparatus explained above will be described in accordance with the first embodiment.

The press-formed member manufacturing method of the first embodiment is configured to manufacture a press-formed member including a bent corner portion by pressure-forming the plate-shaped blank member 10, and includes a thickness increasing process for increasing the thickness of the corner portion by pressure-forming by the thickness increasing device 150. Moreover, prior to the thickness increasing process by the thickness increasing device 150, the blank member 10 is first pressure-formed into a preformed body structure 20 including a bent corner portion by the preforming device 100.

Figure 6:
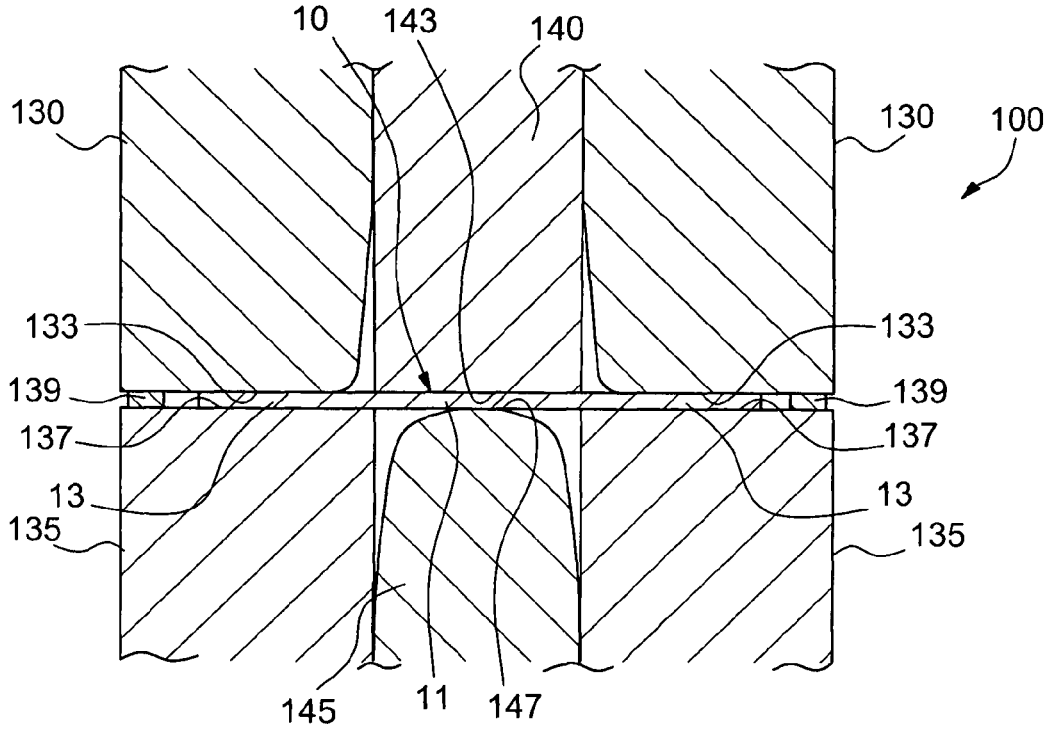
FIG. 6 is a partial cross-sectional view of the preforming device of the press-formed member manufacturing apparatus illustrating work setting in which a blank member is disposed between upper and lower dies in a preforming process in accordance with the first embodiment of the present invention.
Figure 7:
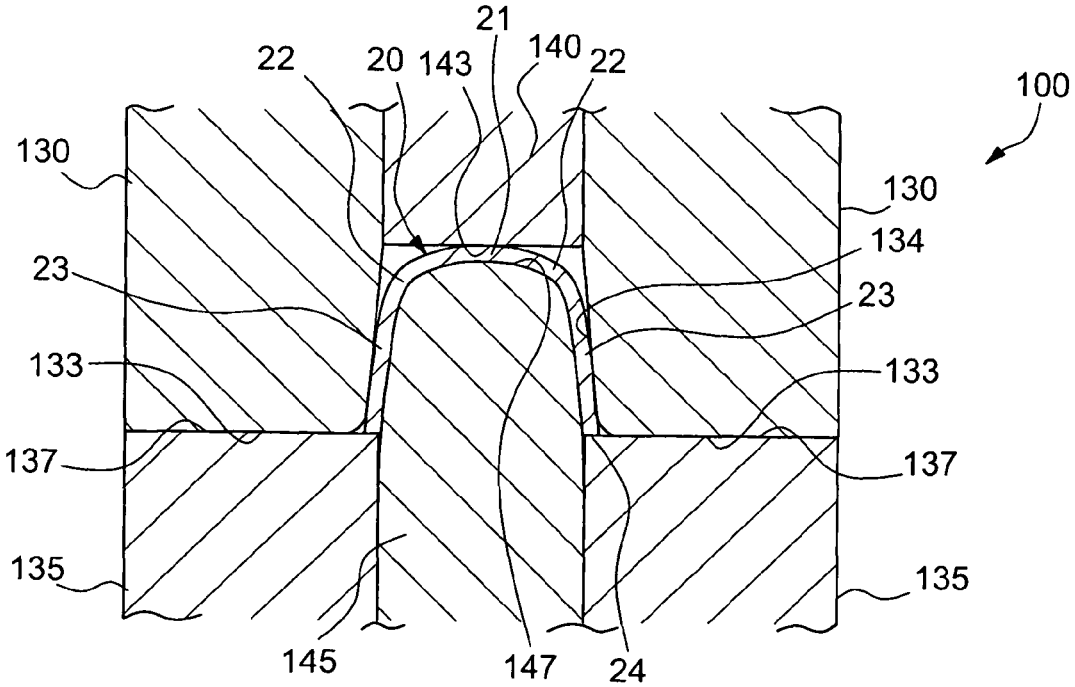
FIG. 7 is a partial cross sectional view of the preforming device of the press-formed member manufacturing apparatus illustrating a pressure-forming process that is performed after the work setting is arranged as illustrated in FIG. 6 in accordance with the first embodiment of the present invention.

FIG. 6 is a partial cross-sectional view of the preforming device 100 of the press-formed member manufacturing apparatus illustrating work setting in which the blank member 10 is disposed between upper and lower die portions of the preforming device 100 in the preforming process. FIG. 7 is the partial cross sectional view of the preforming device 100 of the press-formed member manufacturing apparatus illustrating a pressure-forming process that is performed after the work setting is arranged as illustrated in FIG. 6.

First, the blank member 10 is disposed on the lower die 135 of the preforming device 100. At this time, the first section 11 and the second sections 13 of the blank member 10 are positioned on the opening 138 and the outer peripheral portion 137 of the lower die 135, respectively, such that the press surface 147 of the lower male die 145 contacts the first section 11.

The upper die 130 descends such that the upper die 130 and the lower die 135 are clamped together (see FIG. 6). At this time, the outer peripheral portion 133 of the upper die 130 is positioned on the second sections 13 of the blank member 10, and the press surface 143 of the upper assist die 140 contacts the first section 11 of the blank member 10.

When work setting is completed as shown in FIG. 6, the upper die 130 further descends to press against the lower die 135. Because the lower die 135 retreats, the press surface 147 of the lower male die 145 protrudes from the opening 138 of the lower die 135 and presses against the first section 11 of the blank member 10. The elastically held upper assist die 140 moves simultaneously with the movement of the lower male die 145 and retreats while sliding against the cavity surface 134 of the upper die 130 (see FIG. 7).

The moving amounts of the upper assist die 140 and the lower male die 145 substantially match the size (length) of the second sections 13 of the blank member 10. The cavity surface 134 of the upper die 130 is arranged to generally match the outer contour of the press-formed member. The distal end portion (top surface) of the lower male die 145 is arranged to generally match the inner contour of the press-formed member.

Accordingly, the preformed body structure 20 formed by the preforming device 100 in the preforming step has a generally hat-shaped cross sectional shape including the side walls 23 that are spaced apart and the connecting wall 21 that couples the end portions of the side walls 23 as shown in FIG. 7. As mentioned above, the connecting wall 21 has the convexly curved shape because the press surface 147 of the lower male die 145 has the convexly curved shape.

As described above, in the preforming process illustrated in FIGS. 6 and 7, the plate-shaped blank member 10 is pressure-formed such that the preformed body structure 20 including the corner portion 22 is formed. The occurrence of wrinkles, for examples, is controlled because the movement of the second sections 13 of the blank member 10 is guided by the outer peripheral portion 133 of the upper die 130 and the outer peripheral portion 137 of the lower die 135 during the preforming process.

Next, the thickness increasing process performed by the thickness increasing device 150 will be described in accordance with the first embodiment.

Figure 8:
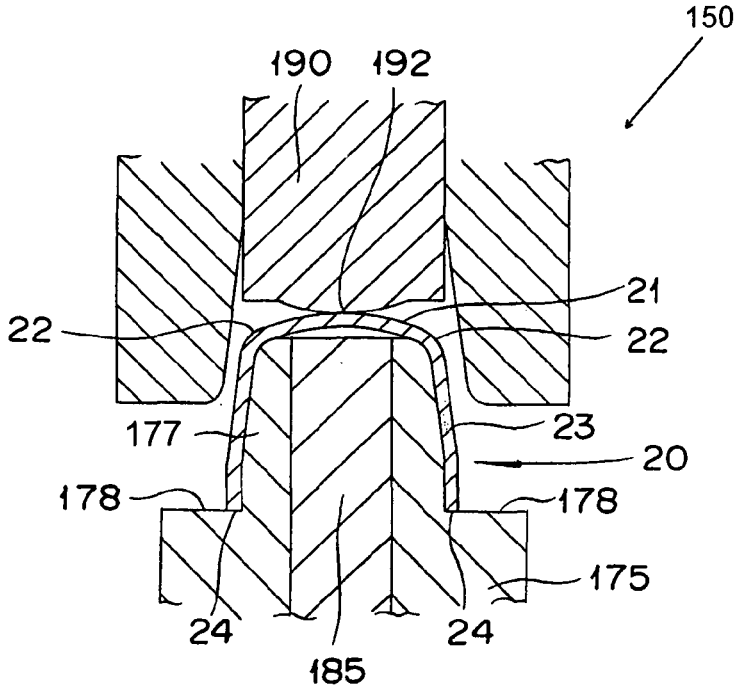
FIG. 8 is a partial cross-sectional view of the thickness increasing device of the press-formed member manufacturing apparatus illustrating a beginning of work setting for a thickness increasing process in accordance with the first embodiment of the present invention.
Figure 9:
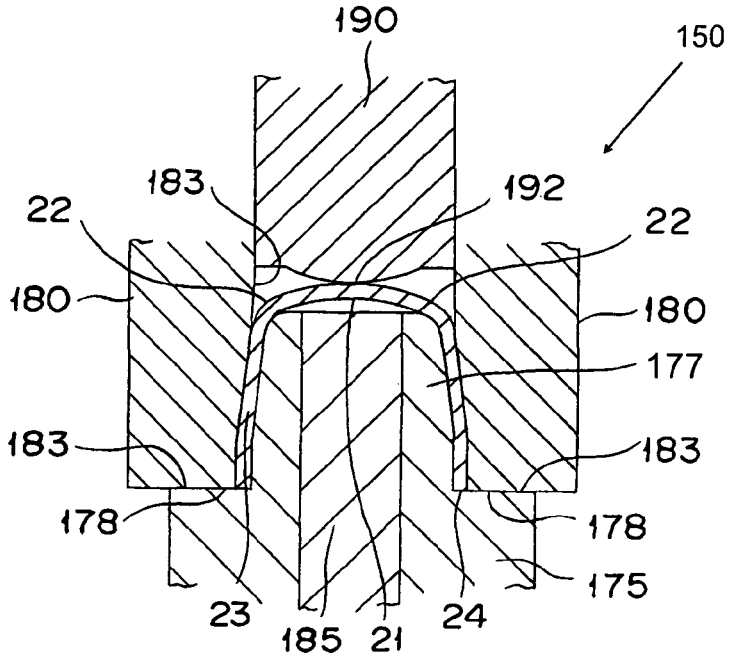
FIG. 9 is a partial cross-sectional view of the thickness increasing device of the press-formed member manufacturing apparatus illustrating an end of the work setting for the thickness increasing process in accordance with the first embodiment of the present invention.
Figure 10:
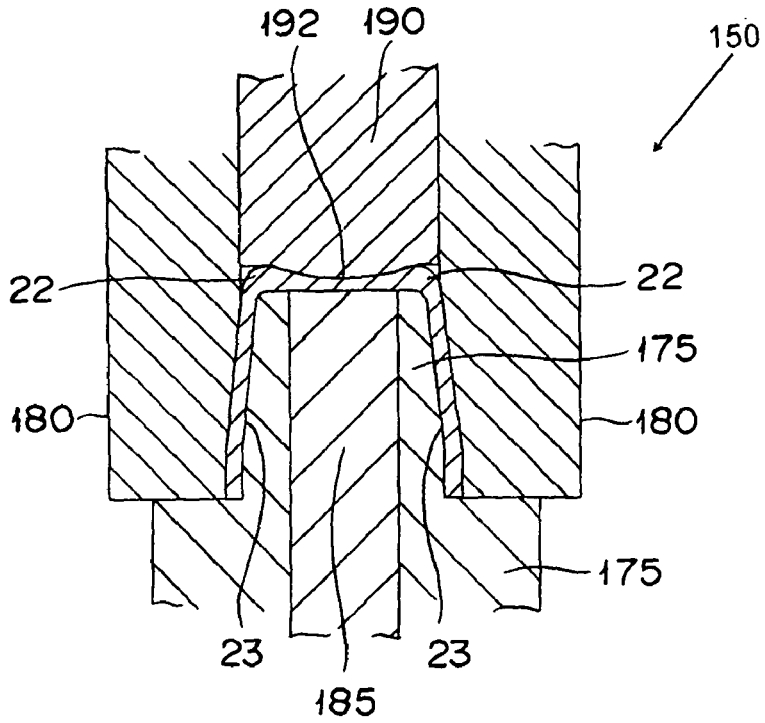
FIG. 10 a partial cross sectional view of the thickness increasing device of the press-formed member manufacturing apparatus illustrating a pressure-forming process for increasing the thickness of the corner portion that is performed after the work setting is arranged as illustrated in FIG. 9 in accordance with the first embodiment of the present invention.
Figure 11:
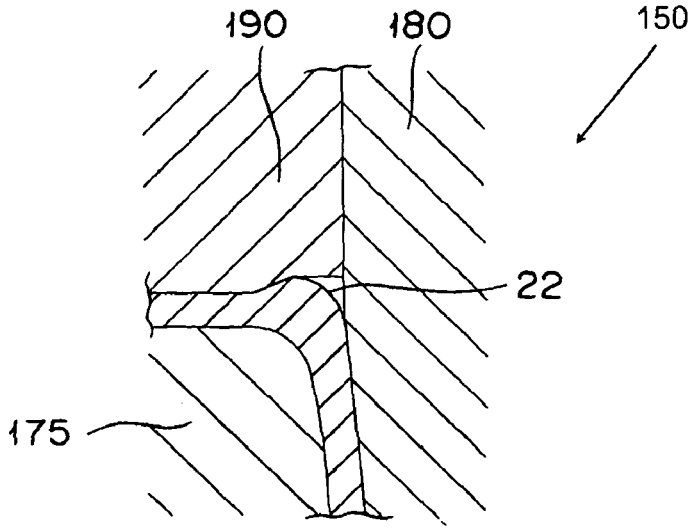
FIG. 11 is an enlarged partial cross sectional view of the thickness increasing device illustrating the corner portion of the press-formed member in accordance with the first embodiment of the present invention.

FIG. 8 is a partial cross-sectional view of the thickness increasing device 150 of the press-formed member manufacturing apparatus illustrating a beginning of work setting for the thickness increasing process in accordance with the first embodiment of the present invention. FIG. 9 is a partial cross-sectional view of the thickness increasing device 150 of the press-formed member manufacturing apparatus illustrating an end of the work setting for the thickness increasing process. FIG. 10 a partial cross sectional view of the thickness increasing device 150 of the press-formed member manufacturing apparatus illustrating a pressure-forming process that is performed after the work setting is arranged as illustrated in FIG. 9. FIG. 11 is an enlarged partial cross sectional view of the thickness increasing device 150 illustrating the corner portion 22 of the press-formed member in accordance with the first embodiment of the present invention.

First, the preformed body structure 20 is disposed so as to be fitted to the core portion 177 of the lower die 175 (see FIG. 5). At this time, the connecting wall 21 of the preformed body structure 20 faces the end surface of the core portion 177 of the lower die 175 and the end surface of the lower assist die 185, and the side walls 23 of the preformed body structure 20 face the outer peripheral surface of the core portion 177 of the lower die 175. The connecting wall 21 of the preformed body structure 20 is elastically supported by the end surface of the lower assist die 185 protruding from the opening of the core portion 177 (see FIG. 5).

Then, the holder 165 descends such that the upper male die 190 contacts and presses against the connecting wall 21 of the preformed body structure 20. The connecting wall 21, together with the lower assist die 185, retreats and contacts the end surface of the core portion 177 (see FIG. 8). At this time, the end surface of the lower assist die 185 is aligned with the end surface of the core portion 177 to integrally form an inner press surface.

The holder 165 further descends such that the upper assist die 180 and the upper male die 190 moves further closer to the lower die 175 and the lower assist die 185, respectively (see FIG. 9).

The side walls 23 of the preformed body structure 20 are sandwiched by the side walls 184 of the upper assist die 180 and the outer peripheral surface of the core portion 177 of the lower die 175. The free end surfaces 24 of the side walls 23 of the preformed body structure 20 contact the abutment surface of the flange portion 178 of the lower die 175.

When the work setting is completed as illustrated in FIG. 9, the holder 165 further descends and pressure-forming is started. The press surface 192 of the upper male die 190 presses the connecting wall 21 of the preformed body structure 20 toward the side walls 23 to cause the material of the connecting wall 21 to flow toward the corner portion 22. As a result, the back side (top side in FIG. 10) of the connecting wall 21 is deformed in the opposite direction (toward the lower die portion) and contacts the inner press surface formed integrally by the end surface of the lower assist die 185 and the end surface of the core portion 177 (see FIG. 10).

As mentioned above, the side walls of the core portion 177, the end surface of the lower die 175, and the end surface of the lower assist die 185 integrally form a cavity surface corresponding to the inner contour of the press-formed member, and the side walls 184 of the upper assist die 180 and the press surface 192 of the upper male die 190 integrally form a cavity surface corresponding to the outer contour of the press-formed member. Therefore, a cavity surface corresponding to the cross-sectional shape of the press-formed member is formed between the upper and lower die portions of the thickness increasing device 150. The clearance or height of sections of the cavity corresponding to the corner portion of the press-formed member is greater than the clearance other sections of the cavity and forms an empty space or an open space such that the material of the connecting wall 21 of the preformed body structure 20 flows toward the side walls 23.

Accordingly, the material flowing to the corner portion 22 increases the thickness of the corner portion 22 (see FIG. 11).

In other words, the thickness of the bent corner portion 22 is increased, whereby the rigidity is improved comparing to the conventional press-formed member in which the rigidity of the bent corner portion may be insufficient.

As described above, in the thickness increasing process, the thickness of the corner portion 22 of the preformed body structure 20 is increased. Since the side walls 184 of the upper assist die 180 and the lower die 175 restrain the movement of the side walls 23 of the preformed body structure 20, the connecting wall 21 of the preformed body structure 20 is reliably pressed toward the side walls 23 by the press surface 192 of the upper male die 190.

Moreover, in the present invention, the width of the connecting wall 21 of the preformed body structure 20 is set to be greater than the width of the connecting wall of the press-formed member after the completion of the thickness increasing process (i.e., the final shape of the press-formed member). Also, the curvature of the corner portion 22 of the preformed body structure 20 is set to be greater than the curvature of the corner portion of the press-formed member of the final shape. In other words, the dimensions and shapes of a preforming die of the preforming device 100 and a thickness increasing die of the thickness increasing device 150, and the dimensions and shapes of the preformed body structure 20 and the finally press-formed member are arranged in advance to have the above-described relationships. Thus, extra material at the connecting wall 21 and the corner portion 22 of the preformed body structure 20 is effectively used as material for increasing the plate thickness of the corner portion in the thickness increasing process.

Accordingly, the rigidity of the press-formed member can be improved by thickening the corner portion without significantly changing the cross-sectional shape of the press-formed member. Moreover, an increase in the weight of the press-formed member and an increase in the material cost (manufacturing cost) can be prevented, which result from using a thick plate blank member as the material of the press-formed member taking into consideration that the thickness of the corner portion is reduced. Furthermore, because the pressure-forming process has excellent productivity in comparison to the welding process, increase in the manufacturing cost can be prevented.

Figure 12:
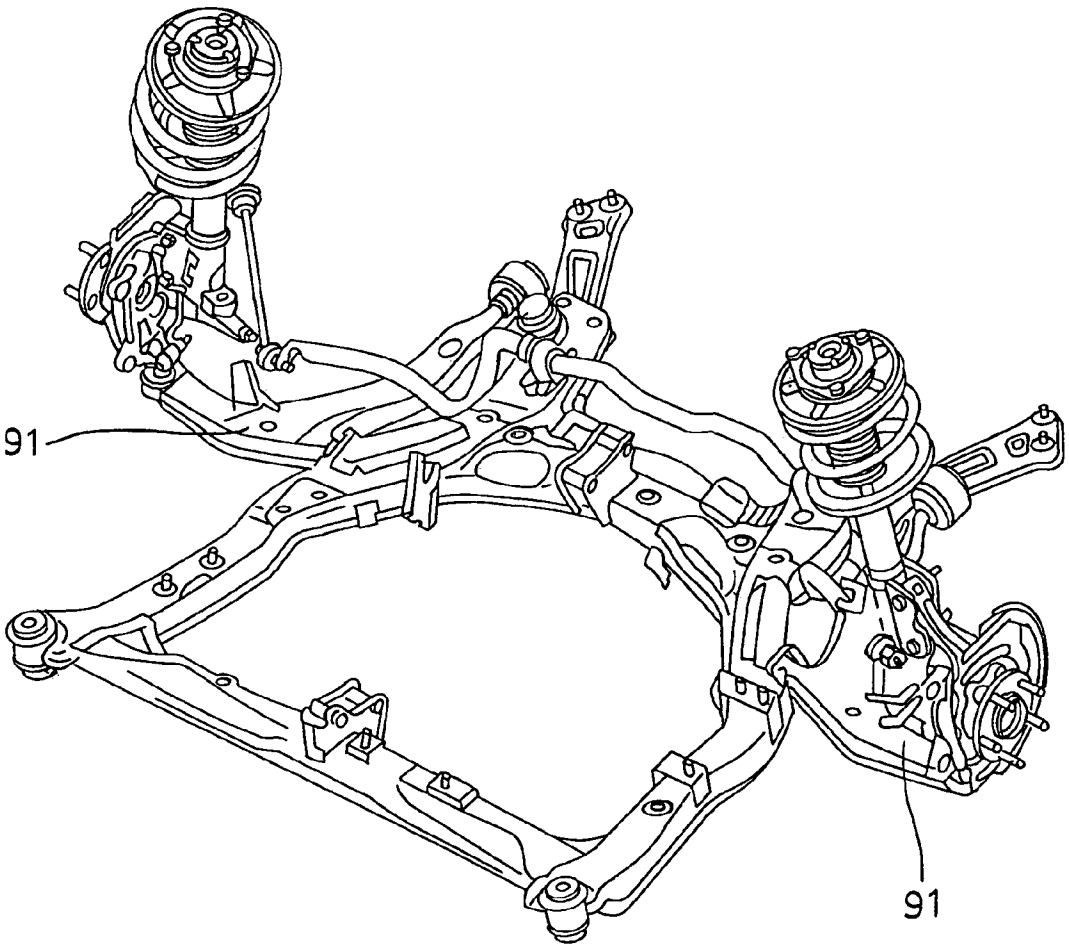
FIG. 12 is a perspective view of another example of the vehicle structure part to which a press-formed member in accordance with the first embodiment of the present invention can be applied.
Figure 13:
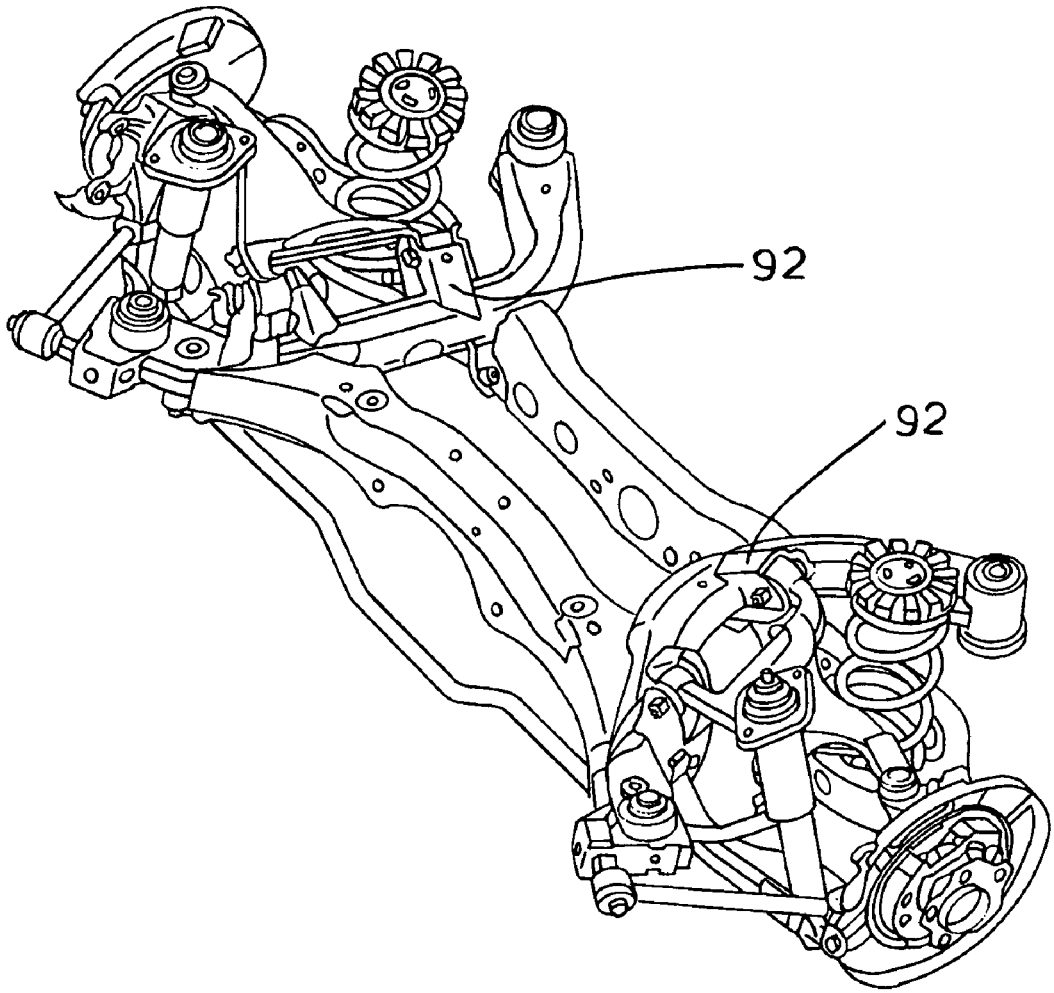
FIG. 13 is a perspective view of further another example of the vehicle structure part to which a press-formed member in accordance with the first embodiment of the present invention can be applied.
Figure 14:
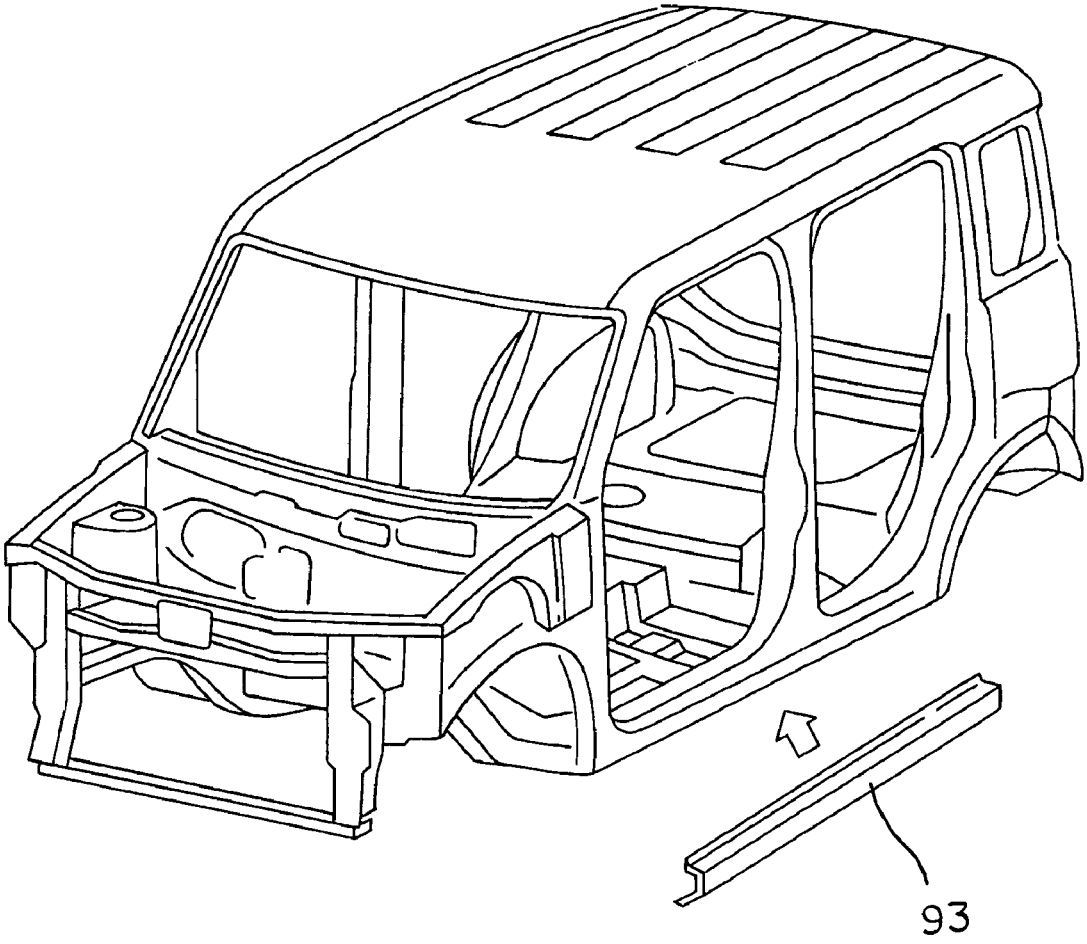
FIG. 14 is a perspective view of further another example of the vehicle structure part to which a press-formed member in accordance with the first embodiment of the present invention can be applied.

The vehicle structure part is not limited to the suspension part 90 shown in FIG. 1 and the press-formed member in accordance with the present invention can also be applied to other parts of the vehicle. FIGS. 12 to 14 illustrate other examples of the vehicle structure part in which the press-formed member in accordance with the first embodiment of the present invention can be applied. More specifically, the press-formed member of the present invention can be formed as a link part 91 as shown in FIG. 12, a member 92 as shown in FIG. 13, a body part 93 such as a side sill outer reinforcement member as shown in FIG. 14, and the like.

Figure 15:
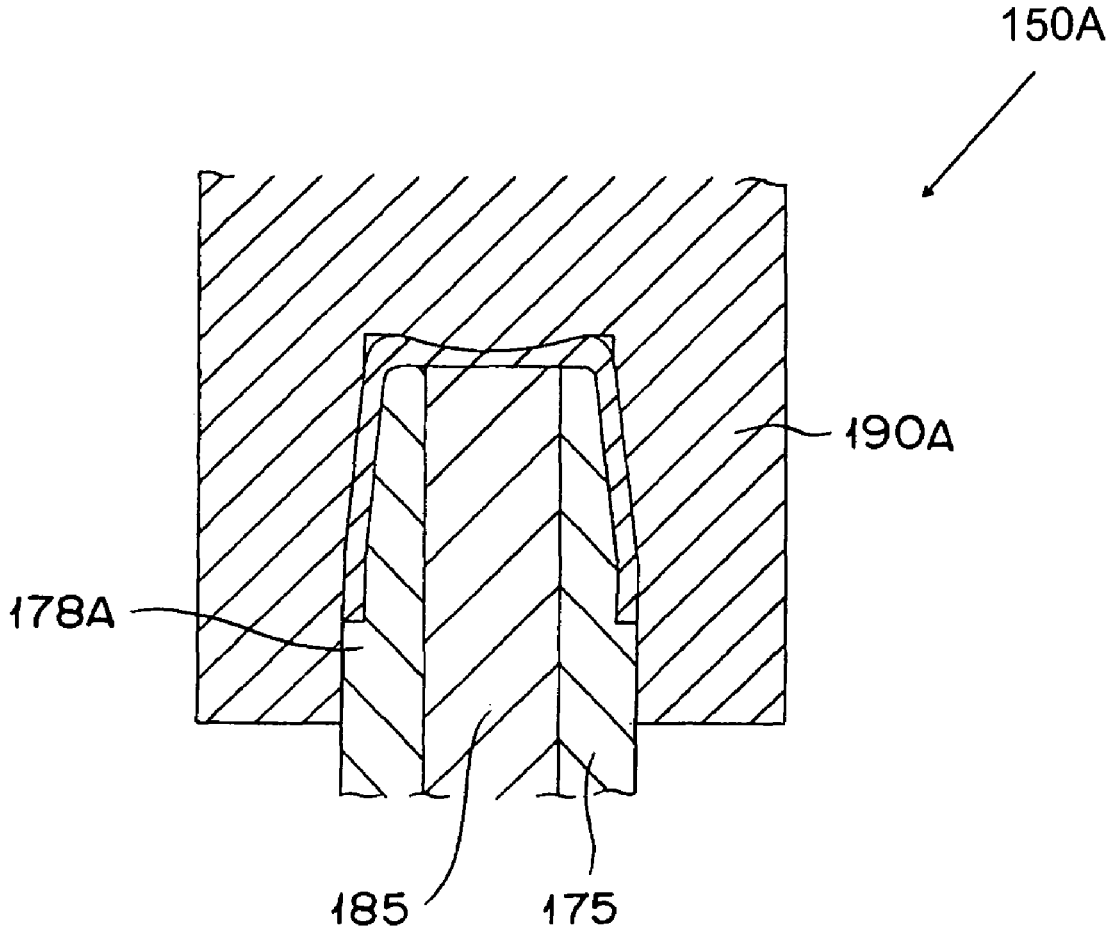
FIG. 15 is a partial cross sectional view of a modified thickness increasing device in accordance with the first embodiment of the present invention.

Moreover, the upper die portion of the thickness increasing device 150 is not limited to a structure that includes the upper die 170, the upper assist die 180, and the upper male die 190 as separate parts. For example, FIG. 15 is a partial cross sectional view of a modified thickness increasing device 150A in accordance with the first embodiment of the present invention. As shown in FIG. 15, the upper die portion of the thickness increasing device 150A includes an integrated die structure 190A. In this case, shape of a flange portion 178A is preferably also adjusted to match the shape of the integrated die structure 190A (upper die portion) as shown in FIG. 15.

As described above, in the first embodiment, the thickness of the corner portion of the press-formed member is arranged greater than the thickness of other portions of the press-formed member (i.e., the side walls and the connecting wall). Consequently, the press-formed member manufacturing method of the first embodiment can reduce the manufacturing cost and the weight of the press-formed member including the bent corner portion. Moreover, the press-formed member manufacturing device can reduce the manufacturing cost and the weight of the press-formed member including the bent corner portion. Furthermore, the press-formed member including the corner portion can be provided with a reduced weight and lower manufacturing cost comparing to the conventional press-formed member.

Second Embodiment

Referring now to FIGS. 16 to 19, a press-formed member manufacturing apparatus in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 16:
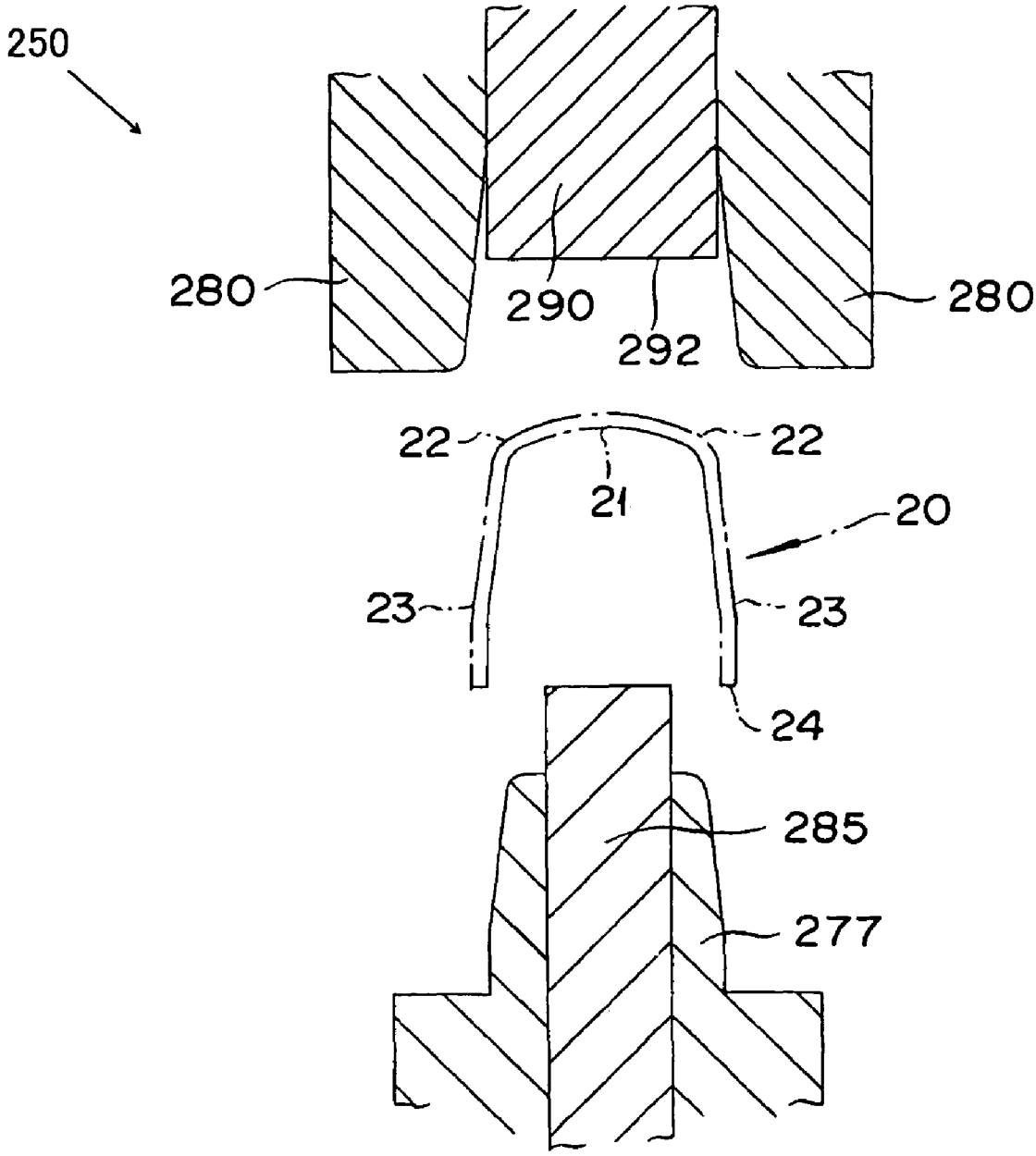
FIG. 16 is a partial cross sectional view of a thickness increasing device of a press-formed member manufacturing apparatus in accordance with a second embodiment of the present invention.
Figure 17:
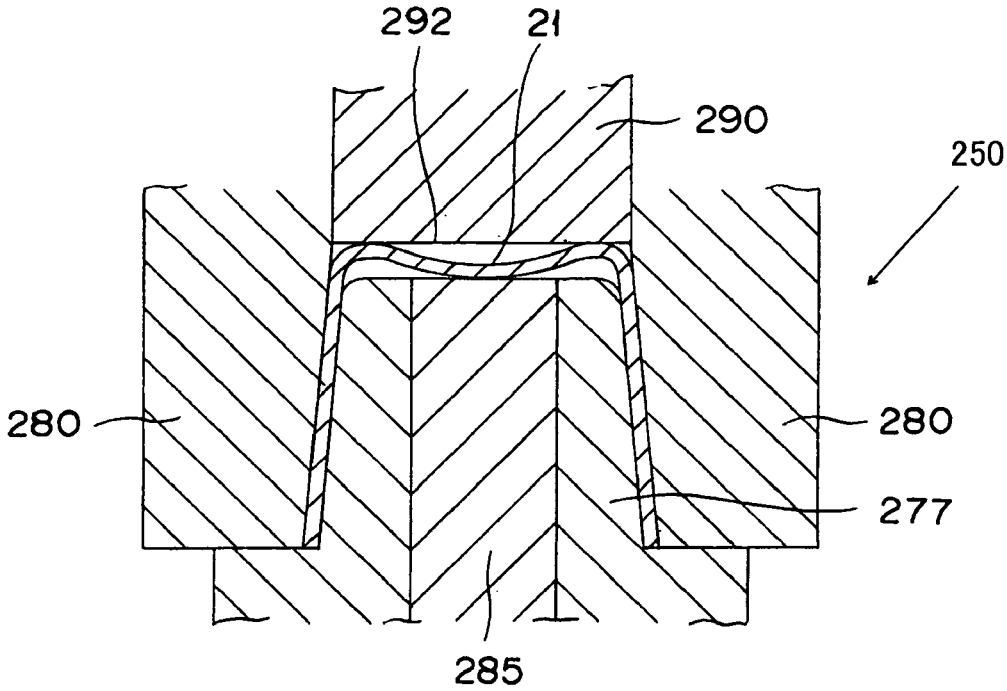
FIG. 17 is a partial cross sectional view of the thickness increasing device of the press-formed member manufacturing apparatus illustrating a pressure-forming process for increasing the thickness of the corner portion of a press-formed member in accordance with the second embodiment of the present invention.
Figure 18:
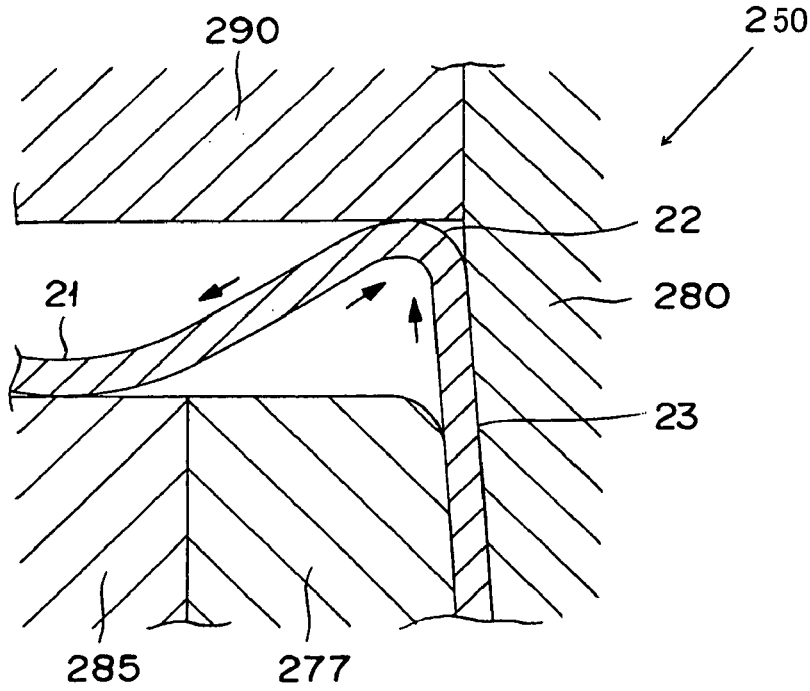
FIG. 18 is an enlarged partial cross sectional view of the thickness increasing device illustrating flow of material in the corner portion of the press-formed member in accordance with the second embodiment of the present invention.
Figure 19:
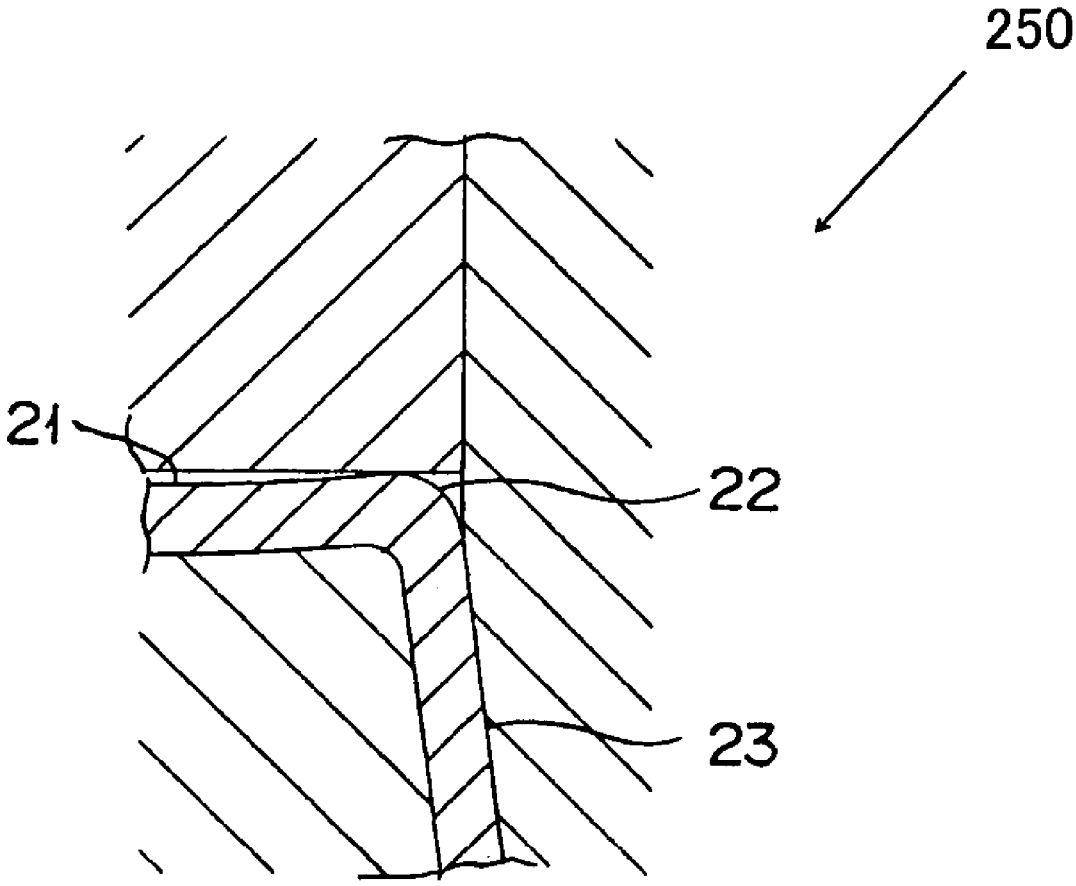
FIG. 19 is an enlarged partial cross sectional view of the thickness increasing device illustrating a state in which the pressure-forming process is completed in accordance with the second embodiment of the present invention.

FIG. 16 is a partial cross sectional view of a thickness increasing device 250 of a press-formed member manufacturing apparatus in accordance with a second embodiment of the present invention. FIG. 17 is a partial cross sectional view of the thickness increasing device 250 of the press-formed member manufacturing apparatus illustrating a pressure-forming process for increasing the thickness of the corner portion of a press-formed member. FIG. 18 is an enlarged partial cross sectional view of the thickness increasing device 250 illustrating flow of material in the corner portion of the press-formed member. FIG. 19 is an enlarged partial cross sectional view of the thickness increasing device 250 illustrating a state in which the pressure-forming process is completed.

The second embodiment of the present invention differs from the first embodiment in that the thickness increasing device 250 is used in the second embodiment instead of the thickness increasing device 150 of the first embodiment. More specifically, the thickness increasing device 250 of the second embodiment differs from the thickness increasing device 150 of the first embodiment in that an upper male die 290 of the thickness increasing device 250 includes a substantially flat press surface 292 (see FIG. 16). The press surface 292 of the second embodiment is arranged to increase the thickness not only of the corner portion 22 of the preformed body structure 20 but also the connecting wall 21 of the preformed body structure 20. As shown in FIG. 17, the upper die portion of the thickness increasing device 250 includes an upper assist die 280 as in the first embodiment.

In the middle of the pressure-forming in the thickness increasing process in the second embodiment, the connecting wall 21 of the preformed body structure 20 becomes recessed and deformed so as to contact a core portion 277 and an end surface of a lower assist die 285 as shown in FIG. 17. At this time, the corner portion 22 of the preformed body structure 20 protrudes toward the upper male die 290 as shown in FIG. 17.

Then, when the connecting wall 21 and the corner portion 22 of the preformed body structure 20 are further deformed with the progression of the pressure-forming process, the corner portion 22 stops protruding and the material of the protruding section of the corner portion 22 gathers as shown in FIG. 18, whereby the thickness of the corner portion 22 of the preformed body structure 20 increases as in the first embodiment (see FIG. 19).

On the other hand, in contrast to the first embodiment, because the press surface 292 of the upper male die 290 is formed as a substantially flat surface, a relatively large empty space (open space) is formed between the press surface 292 and the connecting wall 21 of the preformed body structure 20. Therefore, when the corner portion 22 stops protruding, some of the material of the protruding section of the corner portion 22 easily flows into the connecting wall 21 as shown in FIG. 18. Consequently, the thickness of the connecting wall 21 of the preformed body structure 20 also increases as shown in FIG. 19.

Accordingly, in the second embodiment, it is possible to increase the thickness of the corner portion and the connecting wall of the press-formed member, and a press-formed member where the thickness of the connecting wall is greater than the thickness of the side walls can be obtained.

Third Embodiment

Figure 20:
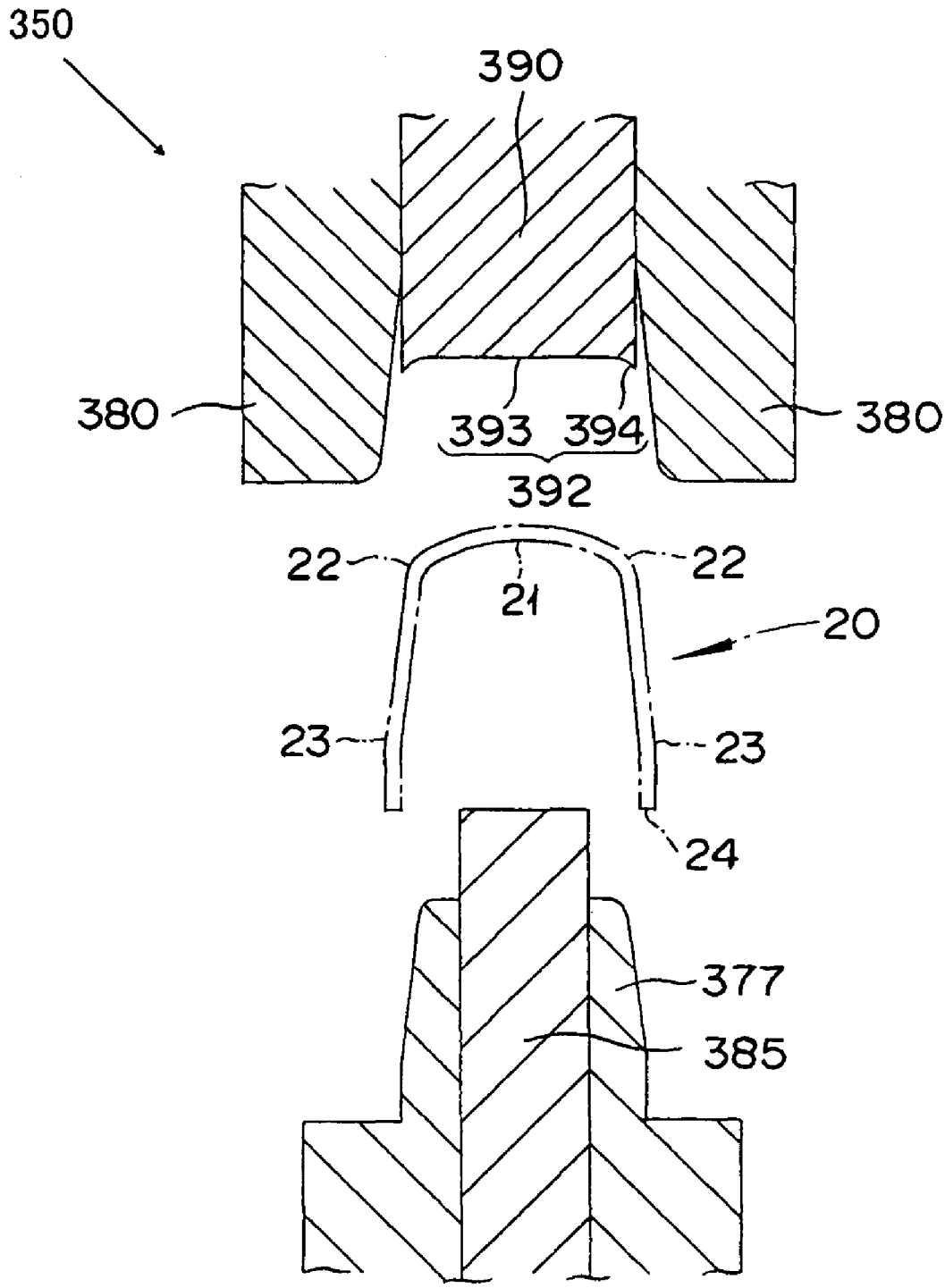
FIG. 20 is a partial cross sectional view of a thickness increasing device of a press-formed member manufacturing apparatus in accordance with a third embodiment of the present invention.
Figure 21:
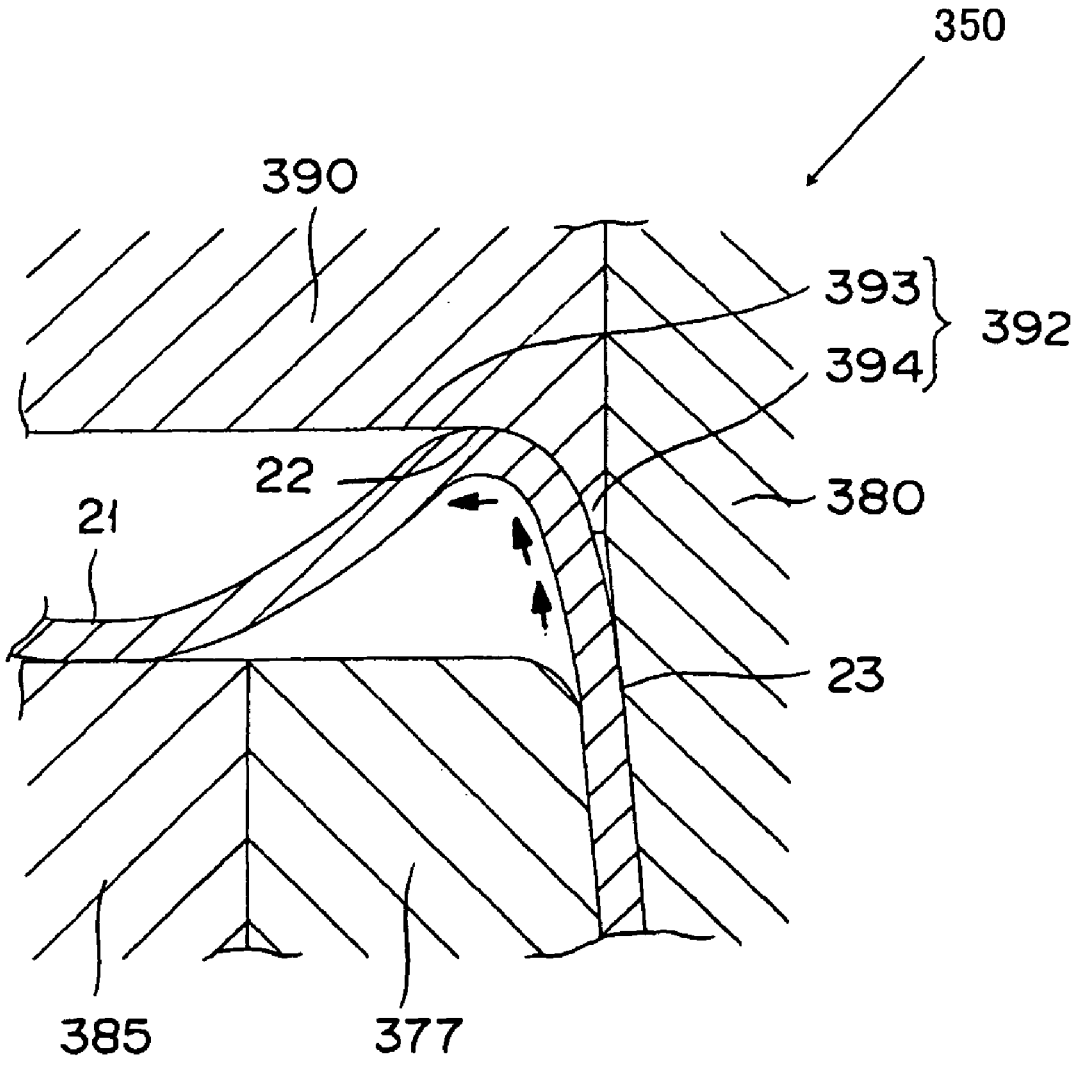
FIG. 21 is an enlarged partial cross sectional view of the thickness increasing device illustrating flow of material in a corner portion of a press-formed member in accordance with the third embodiment of the present invention.

Referring now to FIGS. 20 and 21, a press-formed member manufacturing apparatus in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

FIG. 20 is a partial cross sectional view of a thickness increasing device 350 of the press-formed member manufacturing apparatus in accordance with the third embodiment of the present invention. FIG. 21 is an enlarged partial cross sectional view of the thickness increasing device 350 illustrating flow of material in a corner portion of a press-formed member.

The third embodiment of the present invention differs from the first or second embodiment in that the thickness increasing device 350 is used in the third embodiment instead of the thickness increasing device 150 of the first embodiment. More specifically, the thickness increasing device 350 of the third embodiment differs from the thickness increasing device 150 of the first embodiment in that a press surface 392 of an upper male die 390 of the thickness increasing device 350 has a concaved (inwardly) curved shape and includes a substantially flat center portion 393 and a protruding tapered edge portion 394. The flow characteristics of the material causing an increase in the thickness of the corner portion are different in the third embodiment from the first or second embodiment. As shown in FIG. 20, the upper die portion of the thickness increasing device 350 includes an upper assist die 380 as in the first embodiment.

In the pressure-forming during the thickness increasing process in the third embodiment, the corner portion 22 of the preformed body structure 20 protrudes along the curved surface of the tapered edge portion 394 of the press surface 392 when the connecting wall 21 of the preformed body structure 20 becomes recessed and deformed so as to contact a core portion 377 and an end surface of a lower assist die 385.

Then, when the connecting wall 21 and the corner portion 22 of the preformed body structure 20 are further deformed with the progression of the pressure-forming process, the corner portion 22 stops protruding and the material of the protruding section of the corner portion 22 gathers, whereby the thickness of the corner portion of the press-formed member increases as shown in FIG. 21

On the other hand, because the center portion 393 of the press surface 392 of the upper male die 390 is substantially flat, a relatively large empty space is formed between the center portion 393 and the connecting wall 21 of the preformed body structure 20. For that reason, when the corner portion 22 stops protruding, some of the material of the protruding section of the corner portion 22 easily flows into the connecting wall 21 in the same manner as in the second embodiment, whereby the thickness of the connecting wall 21 of the preformed body structure 20 increases.

At this time, the flow of the material into the connecting wall 21 is accelerated because the tapered edge portion 394 of the press surface 392 of the upper male die 390 that the corner portion 22 of the preformed body structure 20 is contacting is curved.

Accordingly, in the third embodiment, it is possible to more easily increase the thickness of the connecting wall of the press-formed member in comparison to the second embodiment.

Fourth Embodiment

Figure 22:
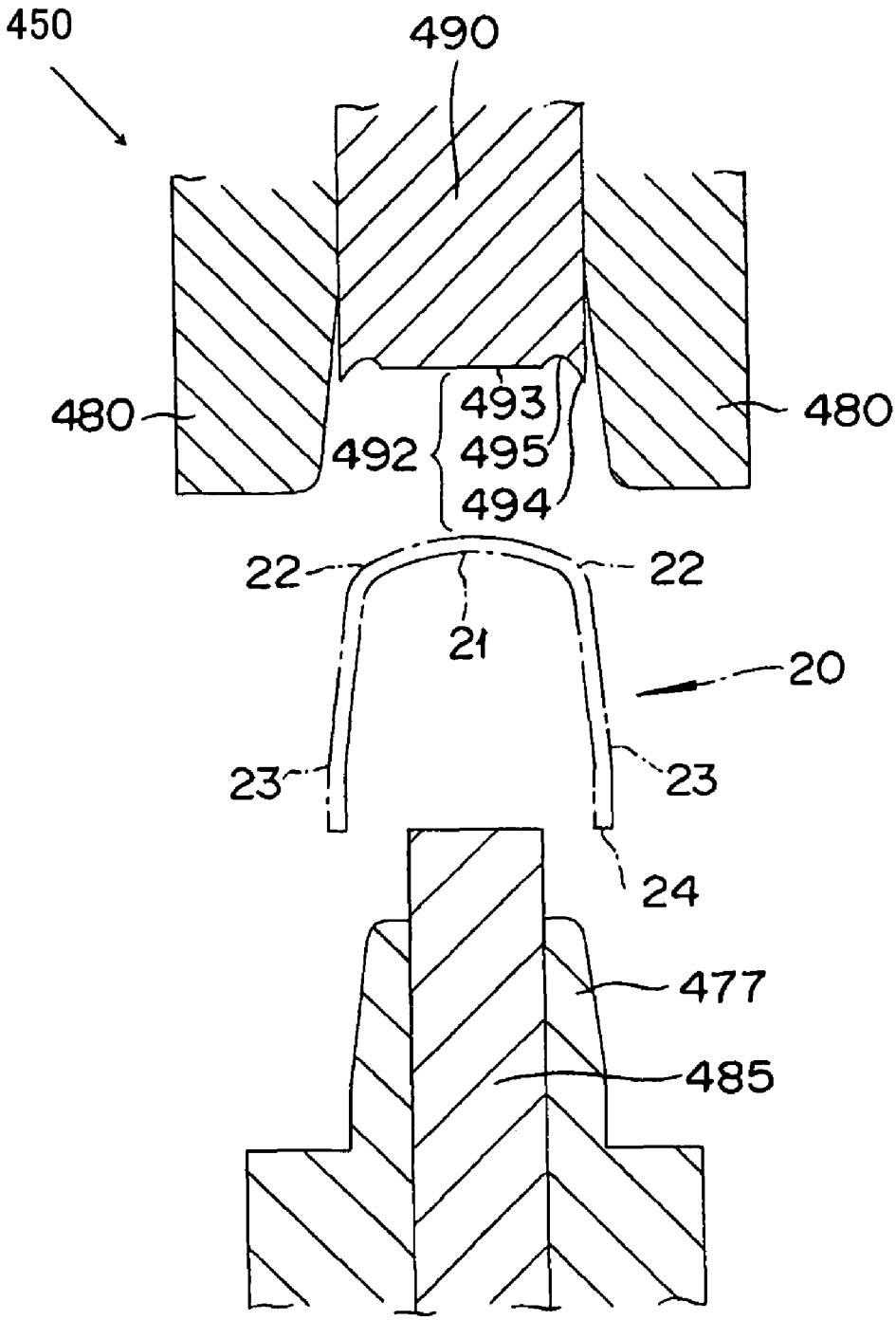
FIG. 22 is a partial cross sectional view of a thickness increasing device of a press-formed member manufacturing apparatus in accordance with a fourth embodiment of the present invention.
Figure 23:
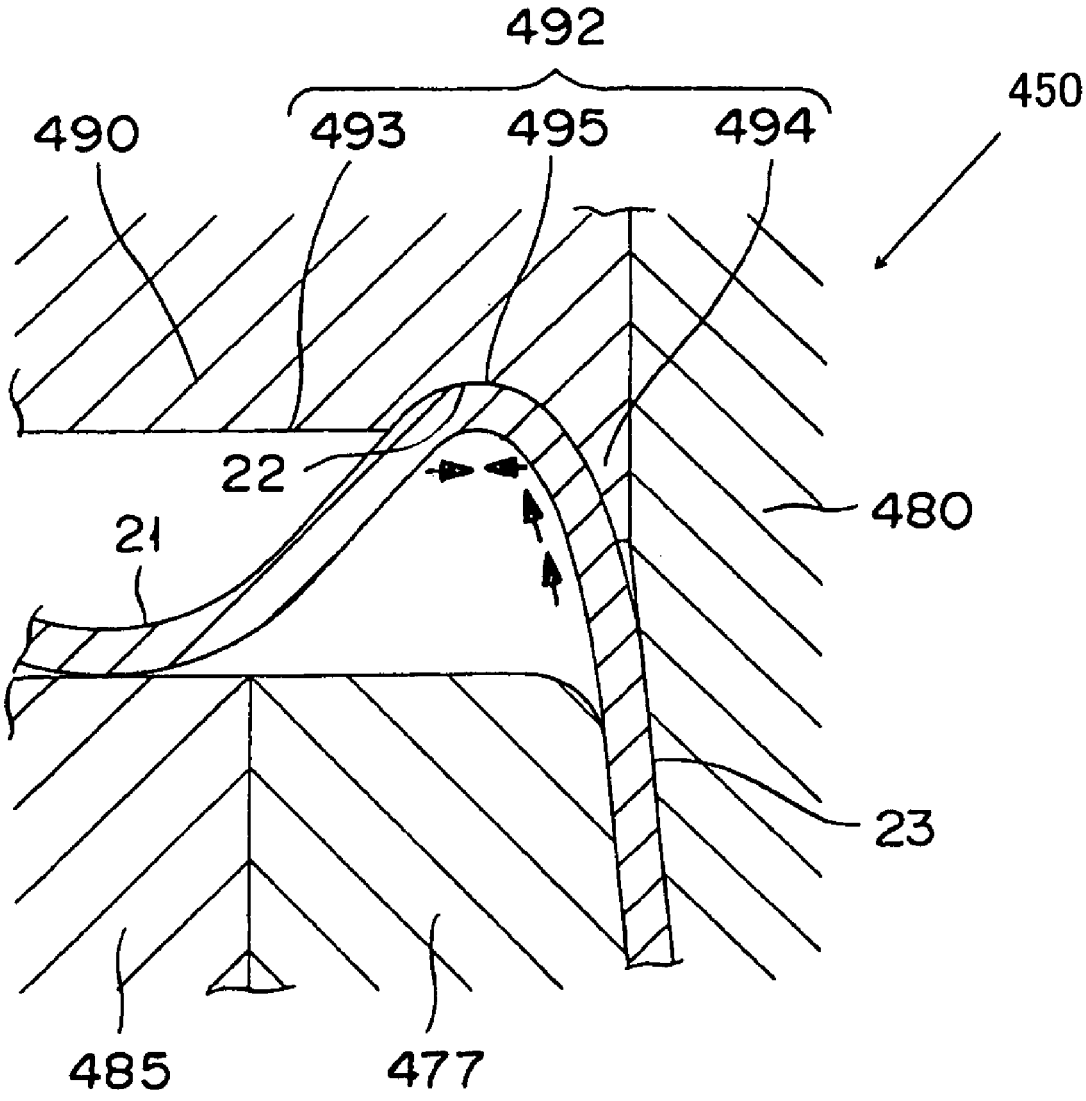
FIG. 23 is an enlarged partial cross sectional view of the thickness increasing device illustrating flow of material in a corner portion of a press-formed member in accordance with the fourth embodiment of the present invention.

Referring now to FIGS. 22 and 23, a press-formed member manufacturing apparatus in accordance with a fourth embodiment will now be explained. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

FIG. 22 is a partial cross sectional view of a thickness increasing device 450 of a press-formed member manufacturing apparatus in accordance with a fourth embodiment of the present invention. FIG. 23 is an enlarged partial cross sectional view of the thickness increasing device 450 illustrating flow of material in a corner portion of a press-formed member.

The third embodiment of the present invention differs from the third embodiment in that the thickness increasing device 450 is used in the fourth embodiment instead of the thickness increasing device 350 of the third embodiment. More specifically, the thickness increasing device 450 of the fourth embodiment differs from the thickness increasing device 350 of the third embodiment in that a press surface 492 of an upper male die 490 of the thickness increasing device 450 further includes a curved recessed portion 495. The recessed portion 495 is disposed on a boundary between a substantially flat center portion 493 and a tapered edge portion 494 and integrally forms a continuous press surface. The flow characteristics of the material causing an increase in the thickness of the corner portion are different in the third embodiment from the first or second embodiment. As shown in FIG. 22, the upper die portion of the thickness increasing device 450 includes an upper assist die 480 as in the first embodiment.

In the pressure-forming during the thickness increasing process in the fourth embodiment, the corner portion 22 of the preformed body structure 20 protrudes along the tapered edge portion 494 and the recessed portion 495 of the press surface 492 when the connecting wall 21 of the preformed body structure 20 becomes recessed and deformed so as to contact a core portion 477 and an end surface of a lower assist die 485.

Then, when the connecting wall 21 and the corner portion 22 of the preformed body structure 20 are further deformed with the progression of the pressure-forming, the corner portion 22 stops protruding and the material of the protruding section of the corner portion 22 gathers, whereby the thickness of the corner portion 22 of the preformed body structure 20 increases.

On the other hand, because the center portion 493 of the press surface 492 of the upper male die 490 is formed as a substantially flat surface, a relatively large empty space (open space) is formed between the center portion 493 and the connecting wall 21 of the preformed body structure 20. Therefore, when the corner portion 22 stops protruding, some of the material of the protruding section of the corner portion 22 easily flows into the connecting wall 21, whereby the thickness of the connecting wall of the press-formed member increases.

At this time, the flow of the material into the connecting wall 21 is accelerated in the same manner as in the third embodiment because the tapered edge portion 494 of the press surface 492 of the upper male die 490 that the corner portion 22 of the preformed body structure 20 are contacting is curved.

However, because the flow of the material into the corner portion 22 is also caused by the presence of the recessed portion 495, the thickness of the corner portion increases more in comparison to the third embodiment. That is, it is possible to control the flow of the material into the connecting wall 21 by changing the shape of the recessed portion 495.

Accordingly, in the fourth embodiment, it is possible to further increase the thickness of the corner portion of the press-formed member in comparison to the third embodiment.

The present invention is not limited to the preceding embodiments and can be variously improved within the scope of the invention as defined in the appended claims. For example, the second through fourth embodiments may be modified as in the modified structure of the upper die portion of the first embodiment as shown in FIG. 15.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A press-formed member manufacturing method comprising:

bending a blank member to form a preliminary body structure including a pair of side walls and a connecting wall disposed between the side walls with a curved corner portion disposed between the connecting wall and each of the side walls, the connecting wall being continuously convexly curved between the curved corner portions, the bending of the blank member to form the preliminary body structure including forming preliminary curvatures of the curved corner portions of the preliminary body structure;

restraining the side walls while applying a pressure to the connecting wall toward the side walls;

and increasing thicknesses of the curved corner portions of the preliminary body structure by applying pressure to the connecting wall toward the side walls to fluidly move parts of material in the connecting wall to the curved corner portions, the applying of the pressure to the connecting wall including creating a concave exterior surface with an inflection point at each end of the concave exterior surface adjacent to the curved corner portions to obtain a final shape of the press-formed member with the inflection points being disposed inward of the curved corner portions.

2. The press-formed member manufacturing method as recited in claim 1, further comprising forming an open space that allows for a flow of the parts of the material in the connecting wall to the curved corner portions.

3. A press-formed member manufacturing apparatus comprising:

a preforming device including a forming die configured and arranged to bend a blank member to form a preliminary body structure including a pair of side walls and a connecting wall disposed between the side walls with a curved corner portion disposed between the connecting wall and each of the side walls, the connecting wall being continuously convexly curved between the curved corner portions, the preliminary body structure having preliminary curvatures of the curved corner portions; and a thickness increasing device including a forming die with a thickness increasing press surface configured and arranged to apply pressure to the preliminary body structure to increase thicknesses of the corner portions of the preliminary body structure by applying pressure to the connecting wall toward the side walls to fluidly move parts of material in the connecting wall to the corner portions and to create a concave exterior surface with an inflection point at each end of the concave exterior surface adjacent to the curved corner portions to obtain a final shape of the press-formed member with the inflection points being disposed inward of the curved corner portions, and a side wall restraining section configured and arranged to restrain the side walls while the press surface applies the pressure to the connecting wall toward the side walls.

4. The press-formed member manufacturing apparatus as recited in claim 3, wherein the forming die of the preforming device further includes a preforming press surface having a convexly curved shape configured and arranged to apply pressure to the blank member to form the connecting wall of the preliminary body structure having a convexly curved shape that protrudes in a direction opposite from the side walls, and the forming die of the thickness increasing device further includes a first thickness increasing die portion configured and arranged to be disposed on a generally inner side of the preliminary body structure having the side wall restraining section, and a second thickness increasing die portion configured and arranged to be disposed on a generally outer side of the preliminary body structure having the thickness increasing press surface.

5. The press-formed member manufacturing apparatus as recited in claim 4, wherein the thickness increasing press surface of the second thickness increasing die portion has a convexly curved shape.

6. The press-formed member manufacturing apparatus as recited in claim 4, wherein the thickness increasing press surface of the second thickness increasing die portion is a substantially flat surface.

7. The press-formed member manufacturing apparatus as recited in claim 4, wherein the thickness increasing press surface of the second thickness increasing die portion has a concaved curved shape including a substantially flat center portion and a protruding tapered edge portion.

8. The press-formed member manufacturing apparatus as recited in claim 7, wherein the thickness increasing press surface of the second thickness increasing die portion further includes a curved recess portion disposed between the center portion and the tapered edge portion.

* * * * *